US010982478B2

(12) United States Patent
Kashiwagi et al.

(10) Patent No.: US 10,982,478 B2
(45) Date of Patent: Apr. 20, 2021

(54) WINDOW REGULATOR

(71) Applicant: Johnan Manufacturing Inc., Nagano (JP)

(72) Inventors: Hideaki Kashiwagi, Nagano (JP); Hideaki Takehara, Nagano (JP)

(73) Assignee: JOHNAN MANUFACTURING INC., Nagano (JP)

( * ) Notice: Subject to any disclaimer, the term of this patent is extended or adjusted under 35 U.S.C. 154(b) by 0 days.

(21) Appl. No.: 16/777,158

(22) Filed: Jan. 30, 2020

(65) Prior Publication Data

US 2020/0256104 A1 Aug. 13, 2020

(30) Foreign Application Priority Data

Feb. 8, 2019 (JP) ..... JP2019-021857

(51) Int. Cl.
*E05D 15/16* (2006.01)
*E05F 11/48* (2006.01)
*E05F 15/689* (2015.01)

(52) U.S. Cl.
CPC ..... *E05D 15/165* (2013.01); *E05F 11/485* (2013.01); *E05F 15/689* (2015.01); *E05Y 2900/55* (2013.01)

(58) Field of Classification Search
CPC ..... E05F 15/689; E05F 11/483; E05F 11/485; E05F 11/382; E05F 11/488; E05F 11/486; E05F 11/445
See application file for complete search history.

(56) References Cited

U.S. PATENT DOCUMENTS

| | | | | |
|---|---|---|---|---|
| 4,403,450 | A * | 9/1983 | Ishii | E05F 11/485 49/352 |
| 5,617,675 | A * | 4/1997 | Kobrehel | E05F 11/485 49/352 |
| 9,677,312 | B2 * | 6/2017 | Marsh | E05F 11/485 |
| 9,803,683 | B2 * | 10/2017 | Simonneau | E05F 7/08 |
| 2019/0136598 | A1 * | 5/2019 | Kinoshita | E05F 11/382 |
| 2019/0136599 | A1 * | 5/2019 | Kinoshita | E05F 11/483 |

FOREIGN PATENT DOCUMENTS

JP H1-154788 U 10/1989

* cited by examiner

*Primary Examiner* — Justin B Rephann
(74) *Attorney, Agent, or Firm* — Roberts Calderon Safran & Cole P.C.

(57) ABSTRACT

A window regulator includes a guide rail provided along an ascending/descending direction of a window for a vehicle, a carrier plate that slides on the guide rail and moves together with the window, a window power feed wire for supplying power to the window, a swing bar arranged to be swingable about the rotational axis thereof that is along a width direction of the vehicle, an elastic member that generates an elastic force for swinging the swing bar in a predetermined direction, and a temporary holding mechanism for temporarily holding the swing bar so that the swing bar extends along the longitudinal direction of the guide rail. The window power feed wire is hung over the swing bar.

7 Claims, 20 Drawing Sheets

WINDOW REGULATOR

CROSS-REFERENCE TO RELATED APPLICATIONS

The present application is based on Japanese patent application No. 2019-021857 filed on Feb. 8, 2019, the entire contents of which are incorporated herein by reference.

TECHNICAL FIELD

The invention relates to a window regulator.

BACKGROUND ART

A window regulator is known which is provided with a guide rail, a carrier plate moving together with a window along the guide rail, a motor driving the carrier plate, a motor power feed wire for supplying power to the motor, and a wire reel for feeding out and taking up the motor power feed wire (see, e.g., JP H1/154788 U).

The wire reel has a rotating pulley for taking up the motor power feed wire, a spiral spring for providing a force to take up the motor power feed wire, and a cover constituting the outer frame, and the force of the spiral spring prevents the motor power feed wire from being slack. This prevents noise caused by contact between the slack motor power feed wire and the inner wall or members of the door and also prevents damage on the motor power feed wire.

Also, the rotating pulley is provided with a contact structure in which a lead wire connected to a battery on a vehicle body to supply power to the motor power feed wire is electrically connected to the motor power feed wire. The inside of the rotating pulley is configured such that a brush provided on the lead wire is in sliding contact with an electrode provided on the motor power feed wire. When the rotating pulley rotates, the brush comes in sliding contact with the electrode and power is thereby supplied to the motor power feed wire. The cover mentioned above provides waterproof for the contact structure.

SUMMARY OF INVENTION

The window regulator described in JP H1/154788 U may cause a problem that the structure of the wire reel is complicated due to the contact structure for the lead wire and the motor power feed wire provided inside the wire reel. Also, if the contact structure is provided outside the wire reel, another waterproofing structure may be needed which is different from the waterproofing structure for the wire reel. In the present invention, a window power feed wire is used for supplying power to a vehicle door window and may have a slack so that the window power feed wire comes into contact with other components inside the door panel and makes noise when closing the door.

Based on this fact, the present inventors studied prevention of the slack of the window power feed wire with a simple structure, using a swing bar with the window power feed wire hanging thereover and swinging within a predetermined angular range, and an elastic member applying an elastic force to the swing bar.

However, depending on the inclined angle of the swing bar, the swing bar may come into contact with other components at the time of installing the window regulator to a door panel. Thus, there is a room for improvement in installation workability.

It is an object of the invention to provide a window regulator that can prevent the slack of the window power feed wire can be removed while having a simple structure without decreasing the installation workability.

According to an aspect of the invention, a window regulator comprises:

- a guide rail provided along an ascending/descending direction of a window for a vehicle;
- a carrier plate that slides on the guide rail and moves together with the window;
- a window power feed wire for supplying power to the window;
- a swing bar arranged to be swingable about the rotational axis thereof that is along a width direction of the vehicle;
- an elastic member that generates an elastic force for swinging the swing bar in a predetermined direction; and
- a temporary holding mechanism for temporarily holding the swing bar so that the swing bar extends along the longitudinal direction of the guide rail, wherein the window power feed wire is hung over the swing bar.

Effect of Invention

According to an embodiment of the invention, a window regulator can be provided that can prevent the slack of the window power feed wire while having a simple structure without decreasing the installation workability.

BRIEF DESCRIPTION OF DRAWINGS

FIGS. 7A to 7D are two-dimensional diagrams illustrating the configuration of the carrier plate, wherein FIG. 7A is a top view, FIG. 7B is a front FIG. 7C is a right side view and FIG. 7D is a back view.

FIGS. 9A to 9C are two-dimensional diagrams illustrating the configuration of the drum housing, wherein FIG. 9A is a top view, FIG. 9B is a front view and FIG. 9C is a right side view.

FIGS. 11A and 11B are two-dimensional diagrams illustrating the configuration of the rail portion, wherein FIG. 11A is a back view and FIG. 11B is a bottom view.

FIGS. 13A to 13F are two-dimensional diagrams illustrating the configuration of the upper end cover, wherein FIG. 13A is a top view, FIG. 13B is a front view, FIG. 13C is a bottom view, FIG. 13D is a left side view, FIG. 13E is a right side view and FIG. 13F is a back view.

FIGS. 15A to 15D are two-dimensional diagrams illustrating the configuration the locking portion, wherein FIG. 15A is a front view, FIG. 15B is a bottom view; FIG. 15C is a back view and FIG. 15D is a right side view.

FIGS. 17A to 17E are two-dimensional diagrams illustrating the configuration of the lower end cover of the swing bar, wherein FIG. 17A is a top view, FIG. 17B is a front view, FIG. 17C is a bottom view, FIG. 17D is a right side view and FIG. 17E is a back view.

FIGS. 20A to 20D are explanatory diagrams illustrating motion of the window regulator, particularly, motion of the swing bar with movement of the carrier plate, wherein FIG. 20A shows the temporarily held state, FIG. 20B shows the state in which the temporarily held state is released, FIG. 20C shows the state in which the carrier plate is located at its top dead center, and FIG. 201) shows the state in which the carrier plate is located at its bottom dead center.

DESCRIPTION OF EMBODIMENTS

First Embodiment

A window regulator 1 in the first embodiment is a device for raising and lowering a window 90 on a door 9 of, e.g., an automobile and is installed on a door panel of the automobile.

(General Configuration of the Window Regulator)

Figure 1:
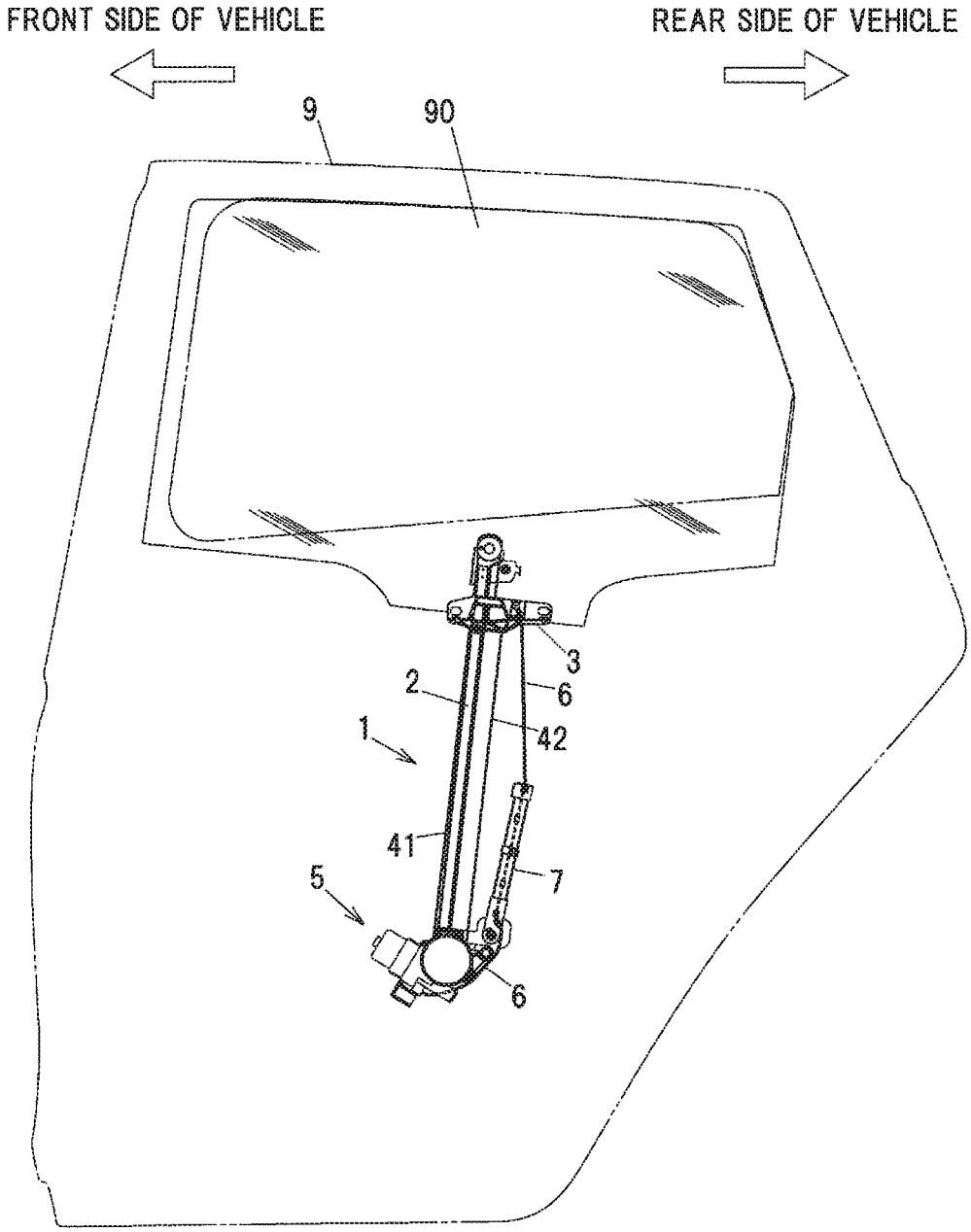
FIG. 1 is a general schematic diagram illustrating a window regulator in the first embodiment of the present invention and a vehicle door mounting the window regulator.
Figure 4:
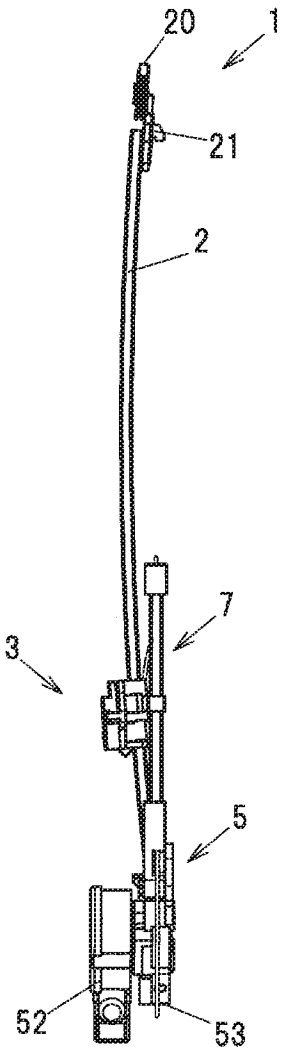
FIG. 4 is a side view showing the configuration of the window regulator in the first embodiment.
Figure 3:
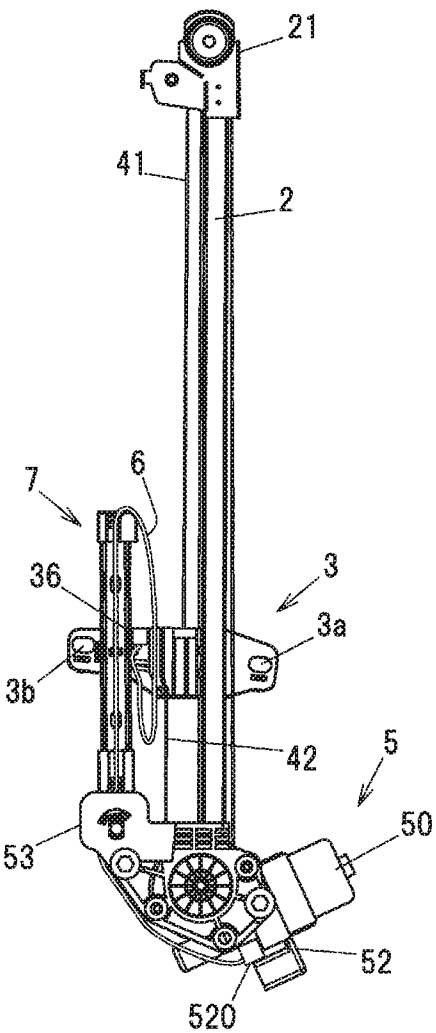
FIG. 3 is a back view showing the configuration of the window regulator in the first embodiment.
Figure 2:
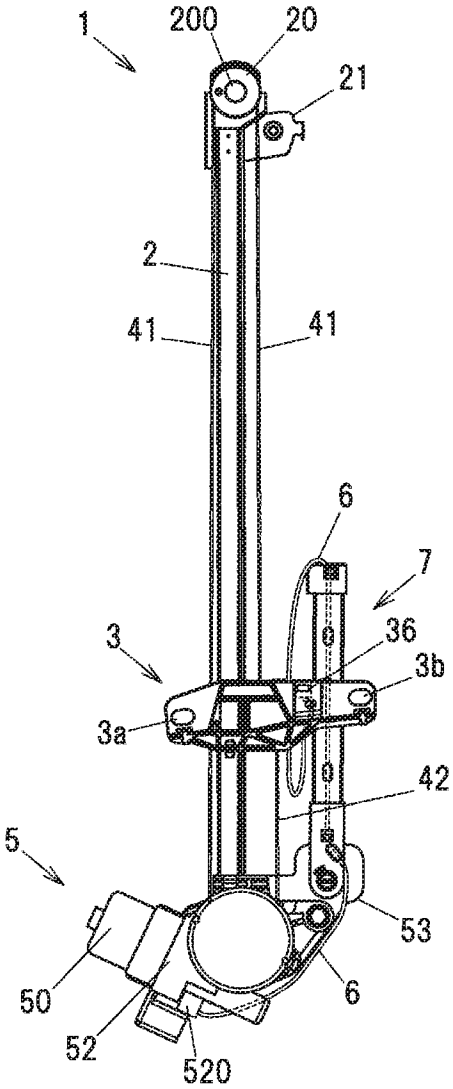
FIG. 2 is a front view showing a configuration of the window regulator in the first embodiment.
Figure 5:
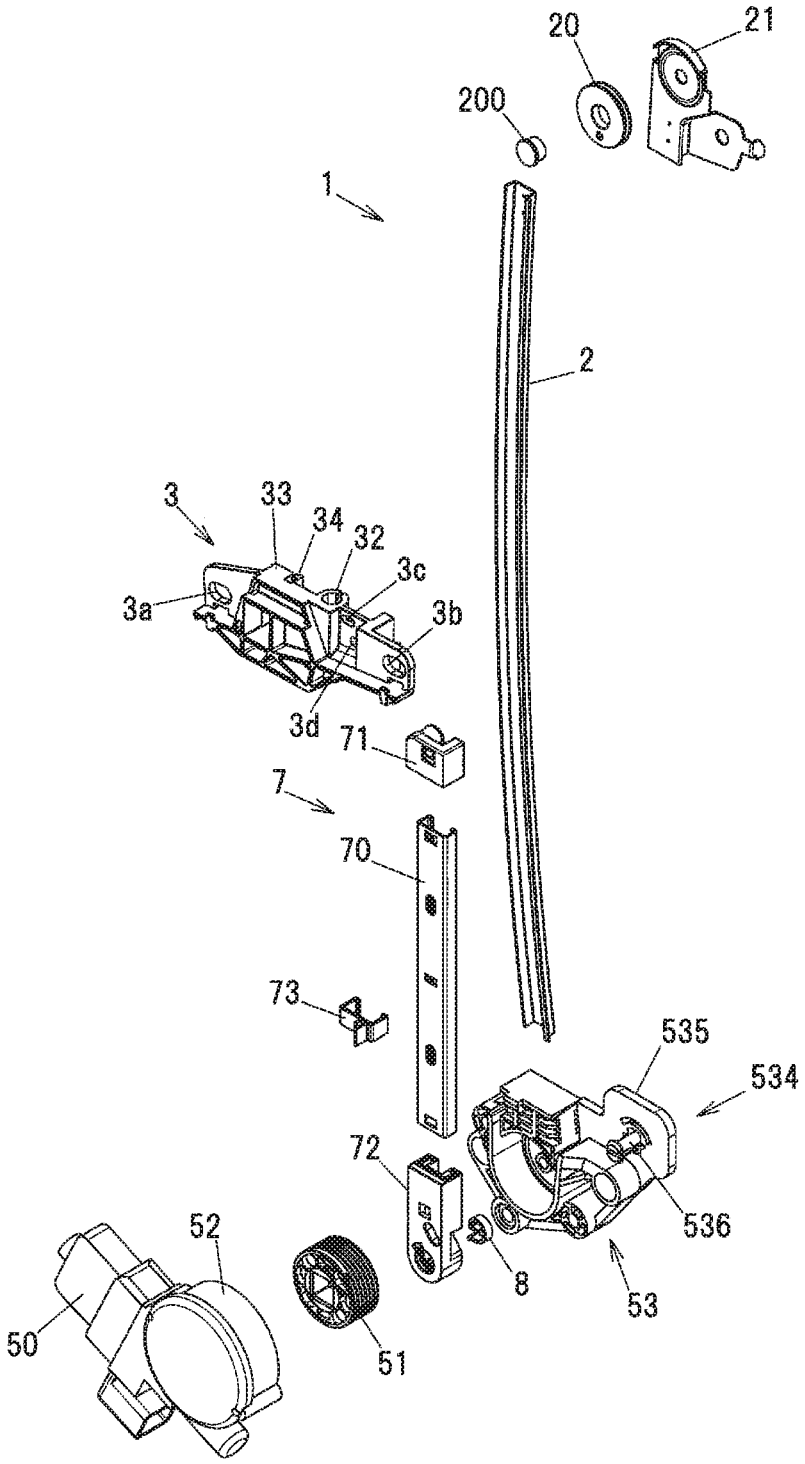
FIG. 5 is an exploded perspective view showing the configuration of the window regulator.

FIG. 1 is a general schematic diagram illustrating the window regulator 1 in the first embodiment and the door 9 of a vehicle mounting the window regulator 1. FIG. 2 is a front view showing a configuration of the window regulator in the first embodiment. FIG. 3 is a back view showing the configuration of the window regulator 1 in the first embodiment. FIG. 4 is a side view showing the configuration of the window regulator 1 in the first embodiment. FIG. 5 is an exploded perspective view showing the configuration of the window regulator 1. In FIG. 1, the window 90 is in a fully-closed state, and the door 9 and a window frame are indicated by phantom lines. In addition, in FIG. 1, the left side of the paper is defined as the front side in the vehicle longitudinal direction and the right side of the paper is defined as the rear side in the vehicle longitudinal direction. In FIGS. 2 to 4, illustration of the window 90 is omitted for convenience of explanation. In the following description, an ascending/descending direction of a window 90 is simply referred to as "the vertical direction".

As shown in FIG. 1, the window regulator 1 is provided with a guide rail which is housed in a door panel (not shown) provided on the door 9 of the vehicle and is arranged along the ascending/descending direction of the window 90 of the vehicle, a carrier plate 3 which slides on the guide rail 2 and moves together with the window 90, an ascending-side cable 41 and a descending-side cable 42 which pull the carrier plate 3, a drive unit 5 which generates a driving force for taking up and feeding out the ascending-side cable 41 and the descending-side cable 42, a window power feed wire 6 for feeding power to the window 90, a swing bar 7 arranged to be swingable with respect to the drive unit 5 and swings in a predetermined direction to remove slack of the window power feed wire 6, an elastic member 8 for applying an elastic force to the swing bar 7, and a temporary holding mechanism 10 for temporarily holding the swing bar 7 so that the swing bar 7 extends along the longitudinal direction of the guide rail 2.

(Guide Rail)

The guide rail 2 is a metal member formed by bending a long metal plate at a predetermined curvature and is arranged so as to tilt to the rear side in the vehicle longitudinal direction with respect to the door 9. The material of the guide rail 2 is not limited to metal and may be, e.g., a resin.

(Ascending-Side Cable and Descending-Side Cable)

The ascending-side cable 41 is coupled to the carrier plate 3 at one end, turns at a pulley 20 provided at the top end of the guide rail 2, and is coupled to a drum 51 (shown in FIG. 5) of the drive unit 5 (described later) at the other end. The descending-side cable 42 is coupled to the carrier plate 3 at one end and is coupled to the drum 51 at the other end. The pulley 20 is rotatably supported, via a rotating pin 200, on a pulley bracket 21 which is fixed to an upper end of the guide rail 2.

The ascending-side cable 41 and the descending-side cable 42 are arranged at positions not overlapping the guide rail 2 when viewed in a vehicle width direction. In other words, to reduce the weight, the guide rail 2 in the embodiment has a smaller length in the vehicle longitudinal direction than typical guide rails.

(Carrier Plate)

Figure 6A:
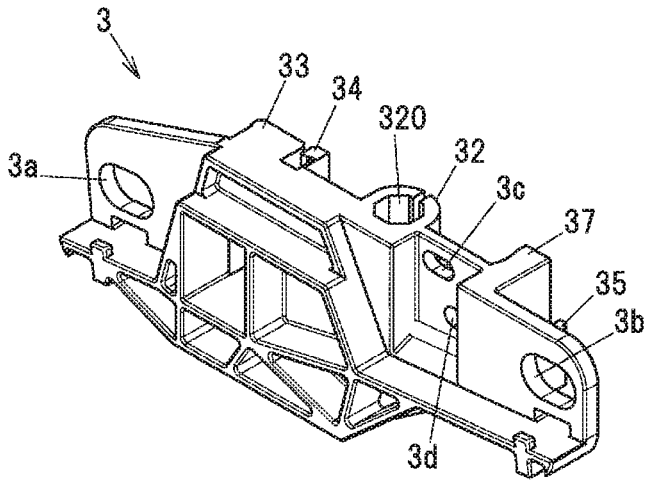
FIGS. 6A and 6B are perspective views showing a configuration of a carrier plate.
Figure 6B:
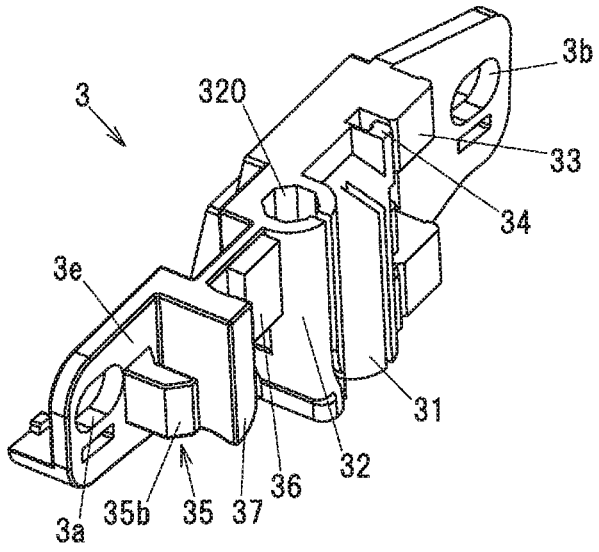
Figure 7A:
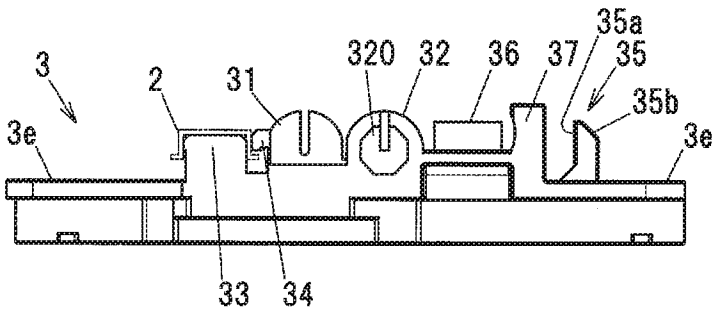
Figure 7B:
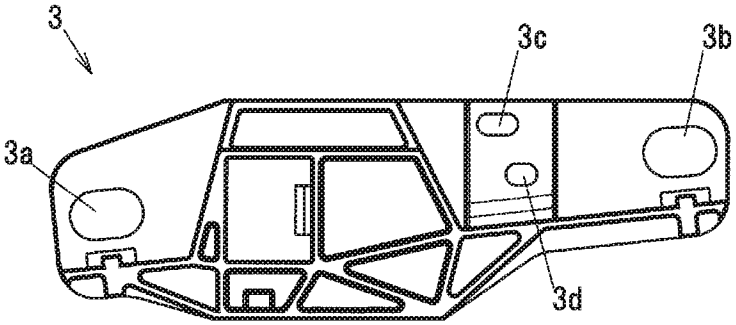
Figure 7C:
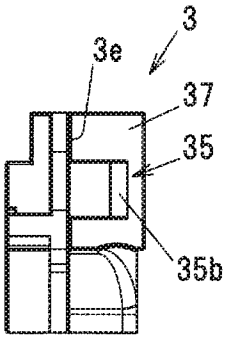
Figure 7D:
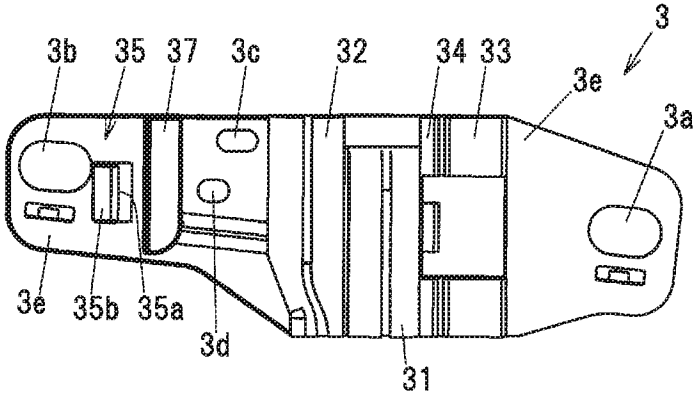

FIGS. 6A and 6B are perspective views showing a configuration of the carrier plate 3. FIGS. 7A to 7D are two-dimensional diagrams illustrating the configuration of the carrier plate 3, wherein FIG. 7A is a top view, FIG. 7B is a front view, FIG. 7C is a right side view and FIG. 7D is a back view.

The carrier plate 3 is a plate-shaped member formed of, e.g., a resin such as polyacetal. The carrier plate 3 has attachment holes 3*a* and 3*b* to which a glass holder (not shown) for coupling to the window 90 is fitted.

As shown in FIG. 7A, an ascending-side cylindrical portion 31 locking one end of the ascending-side cable 41 and a descending-side cylindrical portion 32 locking one end of the descending-side cable 42 are formed on a back surface 3*e* (a surface facing the door panel of the door 9) of the carrier plate 3. The descending-side cylindrical portion 32 has a descending-side housing hole 320 in which the one end of the descending-side cable 42 and a coil spring (not shown) for applying tension to the descending-side cable 42 are housed. Also the ascending-side cylindrical portion 31 has a housing hole formed in the same manner.

A sliding portion 33 allowing the guide rail 2 (indicated by a phantom line) to slide thereon and a guide rail locking portion 34 protruding from a side surface of the ascending-side cylindrical portion 31 and locking one end of the guide rail 2 in the vehicle longitudinal direction are provided on the carrier plate 3 at a position adjacent to the ascending-side cylindrical portion 31. The sliding portion 33 protrudes in a raised manner from the back surface 3*e* of the carrier plate 3.

A power feed connector 36 connected to one end of the window power feed wire 6 is attached to the carrier plate 3 at a position adjacent to the descending-side cylindrical portion 32. The power feed connector 36 is fixed to the back surface 3*e* of the carrier plate 3 through an attachment hole 3*c* formed on the carrier plate 3. A carrier fixing hole 3*d* for fixing the window power feed wire 6 to the back surface 3*e* of the carrier plate 3 is also formed on the carrier plate 3 at the position adjacent to the descending-side cylindrical portion 32, A fixing member (not shown) for fixing the window power feed wire 6 is fixed in the carrier fixing hole 3*d*.

A holding portion 35 which temporarily holds the swing bar 7 in a predetermined position/orientation by coming into contact with a locking portion 73 of the swing bar 7 (described later) is provided on the carrier plate 3 at a position adjacent to the power feed connector 36 on the opposite side to the descending-side cylindrical portion 32. The holding portion 35 protrudes from the back surface 3*e* of the carrier plate 3 and has a substantially rectangular shape when viewed in the thickness direction of the carrier plate 3. Although the holding portion 35 is provided on the back surface 3*e* of the carrier plate 3 in this example, the position of the holding portion 35 is appropriately set according to the position or shape of the locking portion 73 of the swing bar 7 (described later) and the locking method. The holding portion 35 may be provided so as to protrude from, e.g., a side surface of the carrier plate 3, or may be provided so as to protrude from, e.g., an upper or lower surface of the carrier plate 3.

The holding portion 35 has a restricting surface 35*a* for restricting oscillation of the swing bar 7. The restricting surface 35*a* is also a surface facing a carrier wire support portion 37 (described later). The holding portion 35 also has an inclined surface 35*b* formed at an end portion in the protruding direction. The inclined surface 35*b* is inclined so that a distance from the back surface 3*e* of the carrier plate 3 increases toward the guide rail 2 along a direction parallel to the back surface 3*e* of the carrier plate 3 (increases toward the left in FIG. 7A), In addition, the holding portion 35 extends along the travel direction of the carrier plate 3.

The carrier wire support portion 37 for supporting the window power feed wire 6 in tension is provided between the power feed connector 36 and the protrusion 35 of the carrier plate 3. The carrier wire support portion 37 is formed such that an end thereof has an arc shape. This allows the window power feed wire 6 to smoothly extend out of the carrier plate 3. That is, excessive bend and resulting wire breakage are prevented at a portion where the window power feed wire 6 extending out of the carrier plate 3 turns to change the direction.

(Drive Unit)

As shown in FIG. 5, the drive unit 5 has a motor 50, the drum 51 rotated by the motor 50 to take up and feed out the ascending-side cable 41 and the descending-side cable 42, a motor housing 52 holding the motor 50, and a drum housing 53 fixed to a lower end of the guide rail 2 and accommodating the drum 51.

A power supply connector 520 connected to the other end of the window power feed wire 6 is attached to the motor housing 52. An electrical cable such as harness connected to a battery mounted on the vehicle is connected to the power supply connector 520, and the window power feed wire 6 receives power via the power supply connector 520. Although the power supply connector 520 in the first embodiment is provided at a lower portion of the motor housing 52, the mounting position of the power supply connector 520 is not limited thereto.

Drum Housing

Figure 9A:
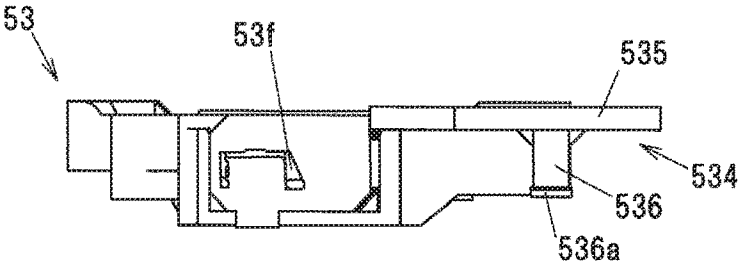
Figure 9B:
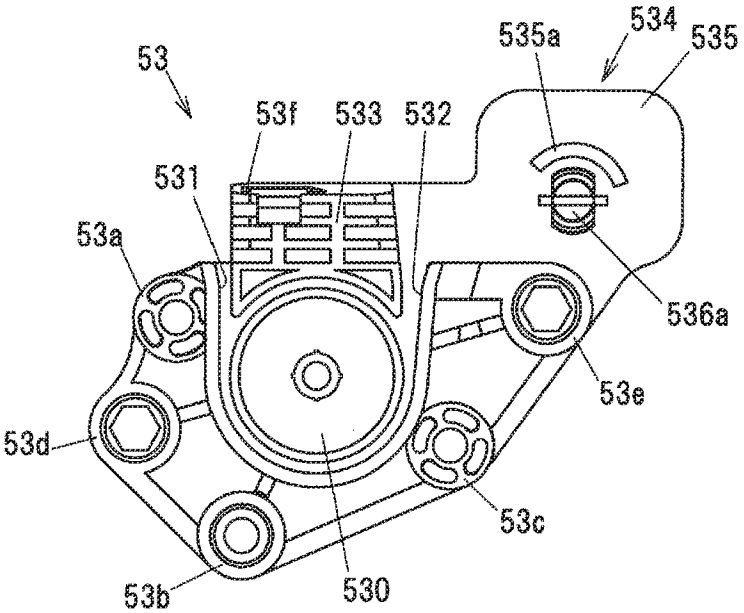
Figure 9C:
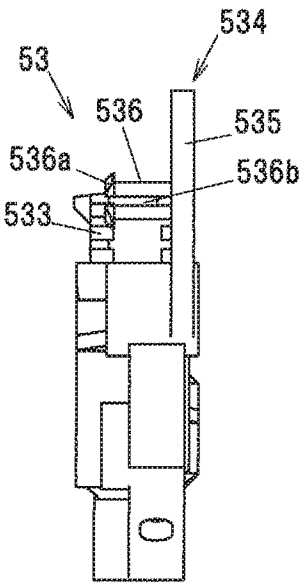
Figure 8:
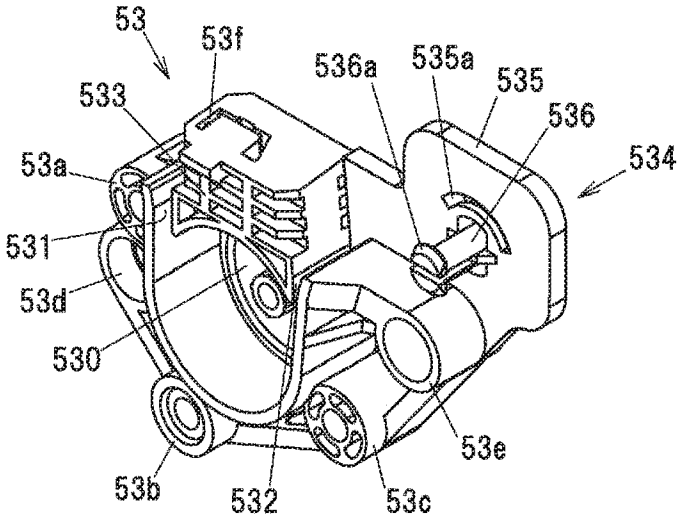
FIG. 8 is a perspective view showing a configuration of a drum housing.

FIG. 8 is a perspective view showing a configuration of the drum housing 53. FIGS. 9A to 9C are two-dimensional diagrams illustrating the configuration of the drum housing 53, wherein FIG. 9A is a top view, FIG. 9B is a front view and FIG. 9C is a right side view.

The drum housing 53 is a resin member and has a bottomed-cylindrical drum housing portion 530 for accommodating the drum 51, first to third motor fixing portions 53*a* to 53*c* for fixing to the motor housing 52, and fourth and fifth vehicle body fixing portions 53*d* and 53*e* for fixing to the door panel. Each fixing portion is fixed by a fastening member such as a bolt.

The drum housing 53 has an ascending-side exit 531 from which the ascending-side cable 41 wound around the drum 51 extends out of the drum housing 53, and a descending-side exit 532 from which the descending-side cable 42 also wound around the drum 51 extends out. The ascending-side exit 531 and the descending-side exit 532 are in communication with the drum housing portion 530.

A rib portion 533 for adding rigidity to the drum housing 53 is provided above the drum housing portion 530 of the drum housing 53. As shown in FIG. 9A, a fitting grove 53*f* for fitting the lower end of the guide rail 2 is formed on the upper surface of the rib portion 533.

The drum housing 53 has a support portion 534 for swingably supporting the swing bar 7. As shown in FIG. 9B, the support portion 534 is positioned on the right side relative to the rib portion 533 on the paper (on the vehicle rear side in FIG. 1).

The support portion 534 is composed of a plate-shaped base portion 535, and a shaft portion 536 which is a pivot point of the swing bar 7 and protrudes from the base portion 535. A through-hole 535*a* having an arc shape is formed on the base portion 535. A stopper 721*a* of a lower end cover 72 of the swing bar 7 (described later) is inserted into the through-hole 535*a*. The elastic member 8 is attached to the shaft portion 536. In the first embodiment, the elastic member 8 is a spiral spring.

The shaft portion 536 protrudes along the vehicle width direction and is positioned at a predetermined distance from the guide rail 2 on the rear side in the vehicle longitudinal direction. In addition, a flange portion 536*a* having a slightly larger diameter than the shaft portion is provided at an end of the shaft portion 536. A gap 536*b* formed along the axial direction is formed on the shaft portion 536, and one end of the elastic member 8 is attached to the gap 536*b*.

(Swing Bar)

The swing bar 7 has a rail portion 70 formed of a metal, an upper end cover 71 attached to an upper end of the rail portion 70, the lower end cover 72 attached to a lower end of the rail portion 70, and the locking portion 73 attached to the middle of the rail portion 70.

The rail portion 70 is formed of a metal and is thus rigid, and this prevents bending due to, e.g., an impact in the vehicle width direction at the time of opening/closing the door 9. However, the material of the rail portion 70 is not limited to the metal and may be, e.g., a resin as long as the rail portion 70 has rigidity.

The swing bar 7 is arranged to be swingable about the rotational axis along the vehicle width direction. In more detail, the swing bar 7 can swing in a first direction and a second direction, where the first direction is a direction in which the upper end cover 71 as a free end located opposite to the lower end cover 72 as a swingably supported end comes close to the guide rail 2, and the second direction is a direction in which the upper end cover 71 moves away from the guide rail 2. The window power feed wire 6 extending out of the power feed connector 36 of the carrier plate 3 is hung over the upper end cover 71.

The swing bar 7 can swing within a predetermined angular range. In the first embodiment, the swing bar 7 is provided to be swingable between a first position/orientation corresponding to the top dead center of the carrier plate 3, a second position/orientation corresponding to the bottom dead center of the carrier plate 3, and a third position/orientation corresponding to a temporarily held state (described later).

The third position/orientation is the position/orientation with which the upper end cover 71 of the swing bar 7 is located closest to the guide rail 2 and the swing bar 7 extends along the longitudinal direction of the guide rail 2. The first position/orientation is the position/orientation which corresponds to the top dead center of the carrier plate 3 and is slightly inclined from the third position/orientation in the second direction. The second position/orientation is the position/orientation with which the upper end cover 71 is located farthest from the guide rail 2 and is along the horizontal direction with an inclination of 90° in the second direction from the third position/orientation. Although the predetermined angular range between the third position/orientation and the second position/orientation is about 90° in the first embodiment, the swingable angular range of the swing bar 7 is not limited thereto and is appropriately set according to the circumferential length (along a circumferential direction about the rotational axis which is the center axis of the shaft portion 536 shown in FIG. 9 and described later) of the through-hole 535*a* formed on the drum housing 53 (described later).

The elastic member 8 constantly applies an elastic force to the swing bar 7 to cause the swing bar 7 to swing in the second direction. The motion of the swing bar 7 will be described in detail later in reference to FIG. 18.

Figure 11A:
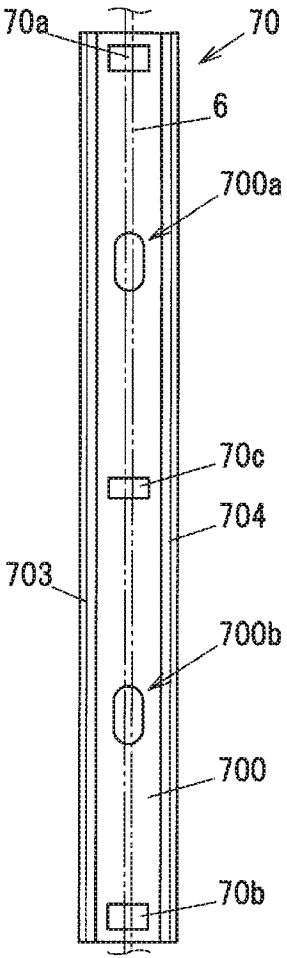
Figure 11B:
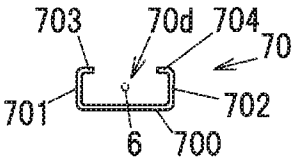
Figure 10:
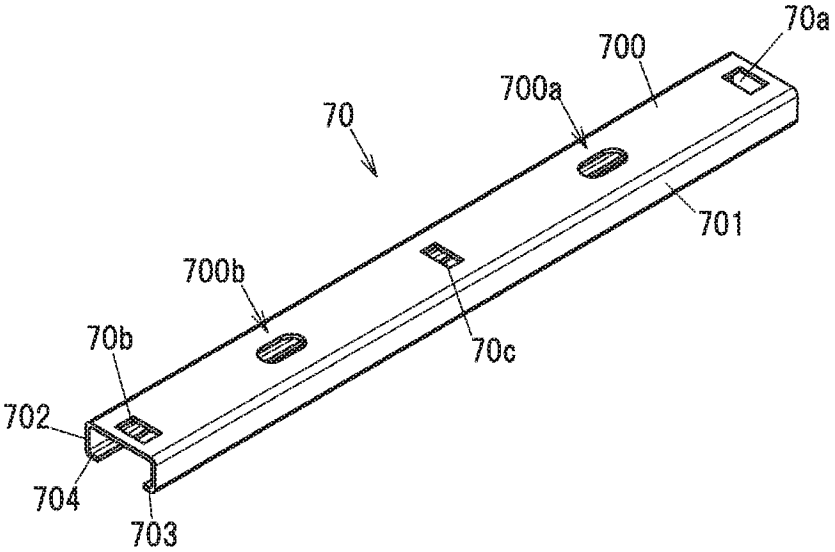
FIG. 10 is a perspective view showing a configuration of a rail portion of a swing bar.

FIG. 10 is a perspective view showing a configuration of the rail portion 70 of the swing bar 7. FIGS. 11A and 118 are two-dimensional diagrams illustrating the configuration of the rail portion 70, wherein FIG. 11A is a back view and FIG. 11B is a bottom view.

As shown in FIGS. 10 and 118, the rail portion 70 integrally has a flat-plate portion 700 extending along the longitudinal direction thereof, first and second side plate portions 701 and 702 rising upright respectively from both edges of the flat-plate portion 700 which are the edges in a lateral direction of the rail portion 70, a first flange portion 703 projecting from an end of the first side plate portion 701 in a direction parallel to the flat-plate portion 700, and a second flange portion 704 projecting from an end of the second side plate portion 702 in the direction parallel to the flat-plate portion 700. The rail portion 70 of the swing bar 7 may be curved in a direction orthogonal to the flat-plate portion 700 of the rail portion 70 or in the lateral direction of the rail portion 70 depending on the shape or structure inside the door panel, and the shape of the rail portion 70 is appropriately set according to the shape or structure inside the door panel.

The first and second flange portions 703 and 704 project inwardly so as to come close to each other. The rail portion 70 has a squared U-shape when viewed in the longitudinal direction thereof.

A portion of the window power feed wire 6 (indicated by a phantom line in FIG. 11) routed between the power supply connector 520 and the power feed connector 36 is arranged on the rail portion 70 along the longitudinal direction. The window power feed wire 6 extending out of the lower end of the rail portion 70 is connected to the power supply connector 520, and the window power feed wire 6 extending out of the upper end of the rail portion 70 is connected to the power feed connector 36.

An upper-end through-hole 70*a* used for attaching the upper end cover 71 is formed on the rail portion 70 on the upper end side. A lower-end through-hole 70*b* used for attaching the lower end cover 72 is formed on the rail portion 70 on the lower end side. A center through-hole 70*c* used for attaching the locking portion 73 is formed at the center of the rail portion 70. Although the center through-hole 70*c* is provided at the center of the rail portion 70, the position of the center through-hole 70*c* may be changed according to the mounting position of the locking portion 73.

The rail portion 70 has a first fixing hole 700*a* and a second fixing hole 700*b* which are formed to fix the window power feed wire 6 to the flat-plate portion 700. The first fixing hole 700*a* is provided between the upper-end through-hole 70*a* and the center through-hole 70*c*, and the second fixing hole 700*b* is provided between the center through-hole 70*c* and the lower-end through-hole 70*b*. Fixing members (not shown) used for fixing the window power feed wire 6 to the flat-plate portion 700 are fixed in the first and second fixing holes 700*a* and 700*b*. Thus, the window power feed wire 6 routed on the rail portion 70 is prevented from being slack. Although two fixing holes, the first fixing hole 700*a* and the second fixing hole 700*b*, are provided at symmetric positions in the longitudinal direction of the rail portion 70 in this example, the number of the fixing holes or the positions thereof on the rail portion 70 may be changed as needed.

The window power feed wire 6 is sandwiched between the first and second side plate portions 701 and 702 and is inserted through an insertion portion 70*d* which is a space extending in the longitudinal direction. In other words, the window power feed wire 6 is routed between the upper and lower ends of the rail portion 70 along the longitudinal direction of the rail portion 70.

Figure 13A:
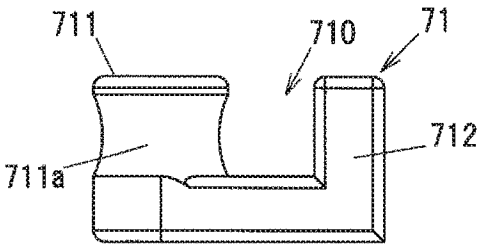
Figure 13E:
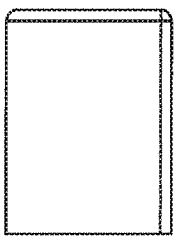
Figure 13B:
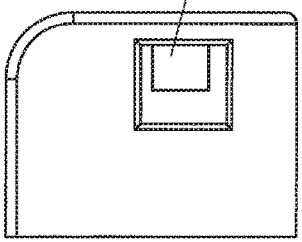
Figure 13D:
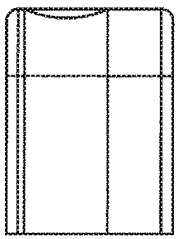
Figure 13F:
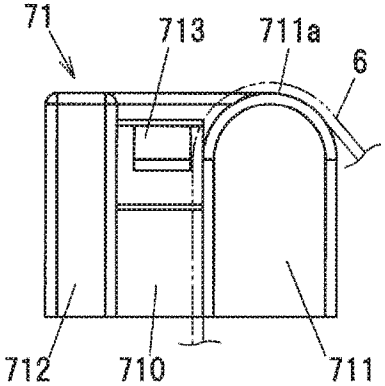
Figure 13C:
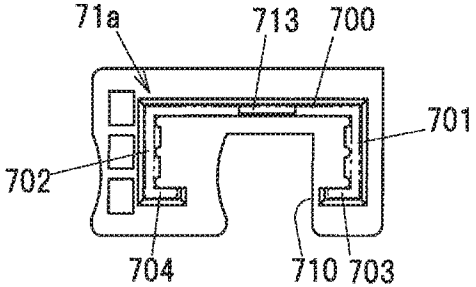
Figure 12:
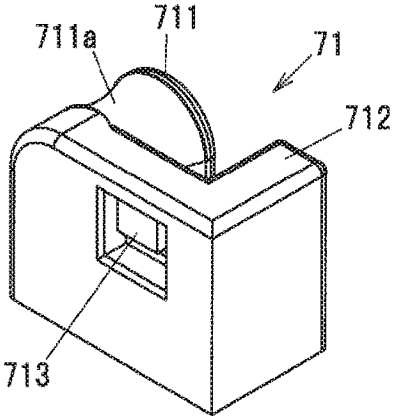
FIG. 12 is a perspective view showing a configuration of an upper end cover of the swing bar.

FIG. 12 is a perspective view showing a configuration of the upper end cover 71 of the swing bar 7. FIGS. 13A to 13F are two-dimensional diagrams illustrating the configuration of the upper end cover 71, wherein FIG. 13A is a top view, FIG. 13B is a front view, FIG. 13C is a bottom view, FIG. 13D is a left side view. FIG. 13E is a right side view and FIG. 13F is a back view.

The upper end cover 71 is a resin member having a substantially rectangular parallelepiped shape as a whole. The upper end cover 71 has a wire support portion 711 for supporting the window power feed wire 6 in tension, a space 710 as an exit for the window power feed wire 6 extending out of the rail portion 70, and a sidewall portion 712 positioned so that the space 710 is sandwiched between the wire support portion 711 and the sidewall portion 712.

The wire support portion 711 is formed so that an end portion thereof has an arc shape. This allows the window power feed wire 6 to smoothly extend out of the upper end cover 71, Thus, excessive bend and resulting wire breakage are prevented at a portion where the window power feed wire 6 extending out of the upper end cover 71 turns to change the direction.

A fitting groove 71*a* for fitting the rail portion 70 is formed on the bottom surface of the upper end cover 71. The upper end cover 71 also has an upper-end fitting portion 713 which is fitted to the upper-end through-hole 70*a* of the rail portion 70. When attaching the upper end cover 71 to the rail portion 70, the upper-end fitting portion 713 of the upper end cover 71 is fitted to the upper-end through-hole 70*a* of the rail portion 70 only by sliding the upper end of the rail portion 70 into the fitting groove 71*a* of the upper end cover 71, hence, easy assembly. In case that the swing bar 7 is formed of a resin, it is possible to integrally mold the upper end cover 71 and the rail portion 70 of the swing bar 7.

Figure 15D:
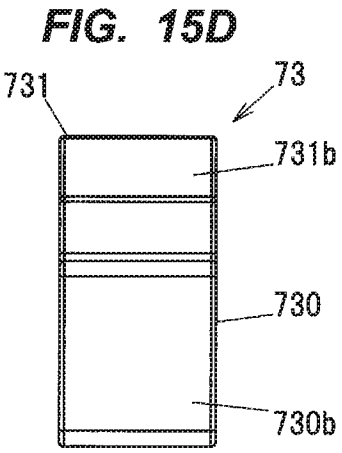
Figure 15A:
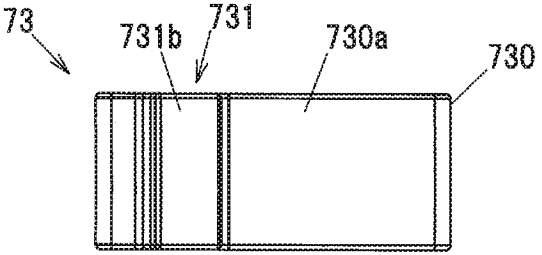
Figure 15B:
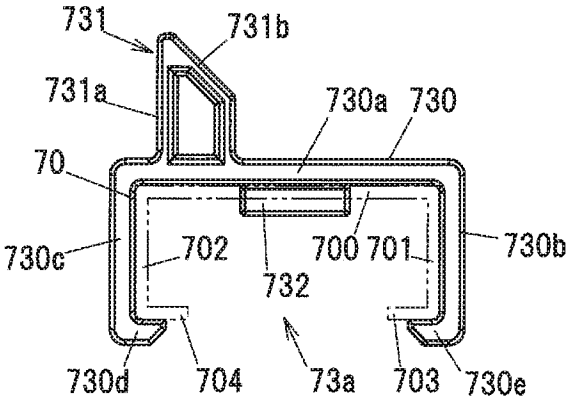
Figure 15C:
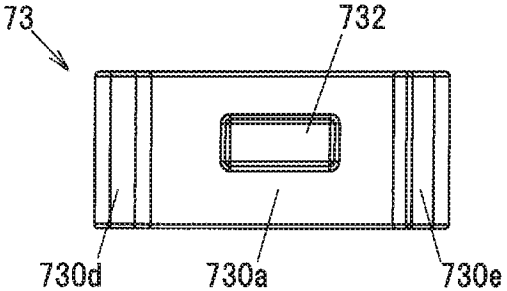
Figure 14:
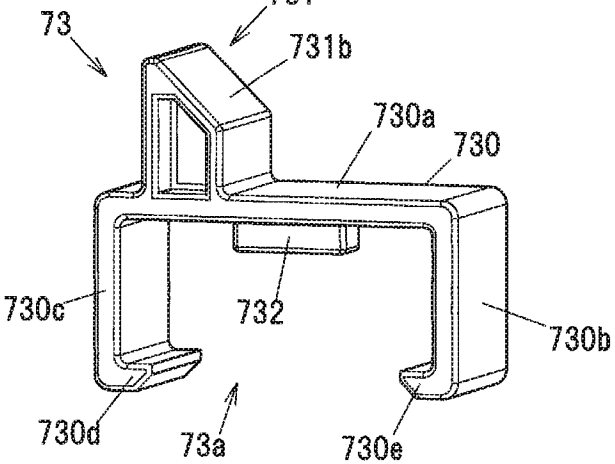
FIG. 14 is a perspective view showing a configuration of a locking portion of the swing bar.

FIG. 14 is a perspective view showing a configuration of the locking portion 73 of the swing bar 7. FIGS. 15A to 15D are two-dimensional diagrams illustrating the configuration of the locking portion 73, wherein FIG. 15A is a front view, FIG. 15B is a bottom view. FIG. 15C is a back view and FIG. 15D is a right side view.

The locking portion 73 is a resin member and integrally has a main body 730 having a squared U-shaped cross section, and a protrusion 731 engaged with the holding portion 35 of the carrier plate 3 in the initial state which is immediately after installing the window regulator 1 to the door panel.

The main body 730 has a flat-plate portion 730*a* having the protrusion 731 on the outer surface, first and second wall portions 730*b* and 730*c*, and first and second claw portions 730*d* and 730*e*. A space between the first and second claw portions 730*d* and 730*e* is formed as an opening 73*a*.

As shown in FIGS. 15B and 15C, a center fitting portion 732 to be fitted to the center through-hole 70*c* of the rail portion 70 is provided on the inner surface of the flat-plate portion 730*a*. The center fitting portion 732 protrudes in a raised manner from the inner surface of the flat-plate portion 730*a*. The locking portion 73 is positioned with respect to the rail portion 70 by fitting the center fitting portion 732 of the locking portion 73 to the center through-hole 70*c* of the rail portion 70.

When attaching the locking portion 73 to the rail portion 70, the center fitting portion 732 of the locking portion 73 is fitted to the center through-hole 70*c* of the rail portion 70 while elastically deforming the first and second wall portions 730*b* and 730*c* of the locking portion 73 so that the opening 73*a* of the locking portion 73 is widened. The locking portion 73 is thereby attached to the rail portion 70.

In this state, the inner surfaces of the first and second claw portions 730*d* and 730*e* of the locking portion 73 are in contact with the outer surfaces of the first and second flange portions 703 and 704 of the rail portion 70, which prevents the locking portion 73 from slipping out of the rail portion 70 in a direction orthogonal to the flat-plate portion 730*a*.

The protrusion 731 protrudes from the flat-plate portion 730*a* of the main body 730. An inclined surface 731*b* inclined with respect to a plane parallel to the flat-plate portion 730*a* is formed at an end of the protrusion 731 in the protruding direction. The protrusion 731 also has a side surface 731*a* which is formed along a direction orthogonal to the flat-plate portion 730*a*. The side surface 731*a* is a contact surface which is in contact with the restricting surface 35*a* of the holding portion 35 of the carrier plate 3 in the temporarily held state (describe later). The protrusion 731 corresponds to "the held portion" of the invention.

Figure 16A:
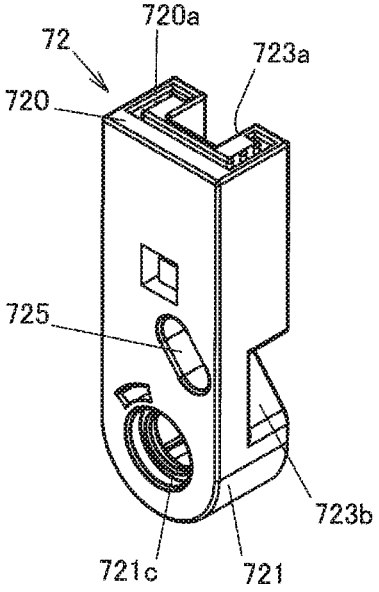
FIGS. 16A and 16B are perspective views showing a configuration of a lower end cover of the swing bar.
Figure 16B:
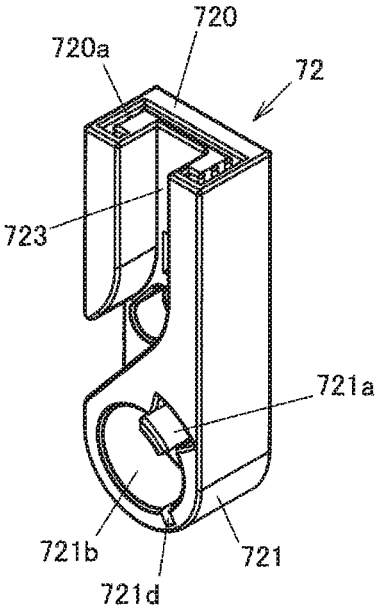
Figure 17A:
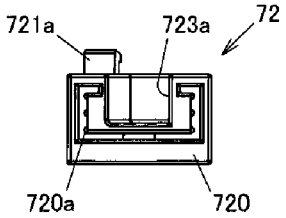
Figure 17B:
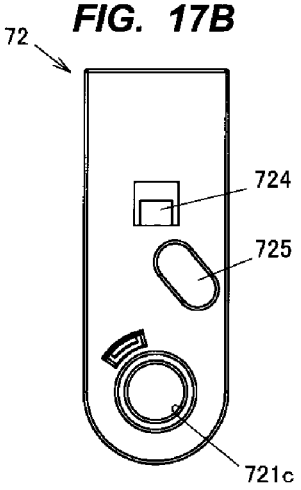
Figure 17D:
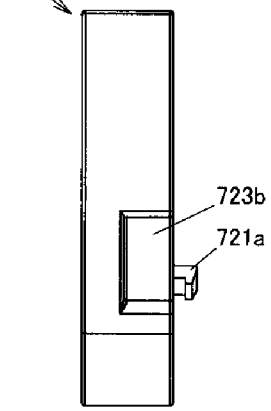
Figure 17E:
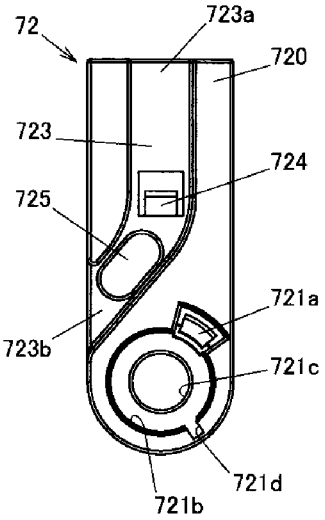
Figure 17C:
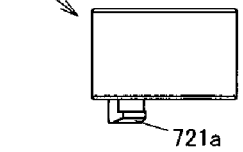

FIGS. 16A and 16B are perspective views showing a configuration of the lower end cover 72 of the swing bar 7. FIGS. 17A to 17E are two-dimensional diagrams illustrating the configuration of the lower end cover 72, wherein FIG. 17A is a top view, FIG. 17B is a front view, FIG. 17C is a bottom view, FIG. 17D is a right side view and FIG. 17E is a back view.

The lower end cover 72 is a resin member and has a rail support portion 720 for supporting the rail portion 70 of which lower end is fitted thereto, an attached portion 721 located at the lower end of the rail support portion 720 and rotatably attached to the drum housing 53, and a window power feed wire-exit portion 723 from which the window power feed wire 6 routed along the rail portion 70 extends out toward the power supply connector 520. A lower-end fixing hole 725 used for fixing the window power feed wire 6 to the lower end cover 72 is formed on the window power feed wire-exit portion 723 of the lower end cover 72, and a fixing member (not shown) used for fixing the window power feed wire 6 is fixed in the lower-end fixing hole 725.

The rail support portion 720 of the lower end cover 72 has a fitting hole 720*a* to which the lower end of the rail portion 70 is fitted.

The window power feed wire-exit portion 723 of the lower end cover 72 is a groove which is a recess on a surface of the rail support portion 720 facing the rail portion 70. At the window power feed wire-exit portion 723, the window power feed wire 6 is inserted from an insertion entrance 723*a* which is an opening on the upper surface of the rail support portion 720, and the window power feed wire 6 extends out from an exit 723*b* formed on a side surface of the rail support portion 720.

The attached portion 721 of the lower end cover 72 is provided with the stopper 721*a* to be inserted into the through-hole 535*a* of the base portion 535 of the drum housing 53, a cylindrical housing portion 721*b* for accommodating the elastic member 8, an insertion hole 721*c* which is in communication with the housing portion 721*b* and into which the shall portion 536 of the drum housing 53 is inserted, and a spring locking groove 721*d* locking the other end of the elastic member 8. The elastic member 8 is coupled to the shaft portion 536 of the drum housing 53 at one end and is locked in the spring locking groove 721*d* of the lower end cover 72 at the other end.

A lower-end fitting portion 724 to be fitted to the lower-end through-hole 70*b* of the rail portion 70 is provided on the lower end cover 72. This facilitates the positioning of the lower end cover 72 with respect to the rail portion 70. In case that the swing bar 7 is formed of a resin, it is possible to integrally mold the lower end cover 72 and the rail portion 70 of the swing bar 7.

The stopper 721*a* of the lower end cover 72 is arranged movable in the through-hole between one end and the other end in the circumferential direction thereof. In other words, the lower end cover 72 swings in a range in which the stopper 721*a* thereof moves in the through-hole 535*a* of the drum housing 53.

(Temporary Holding Mechanism)

Figure 18:
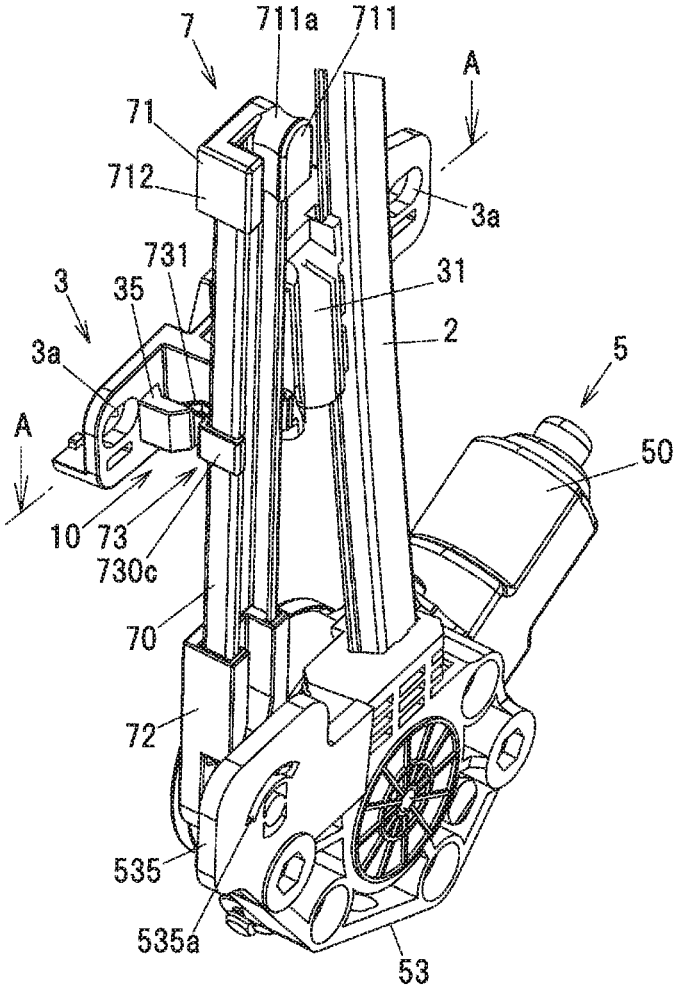
FIG. 18 is a perspective view showing a configuration of a temporary holding mechanism.
Figure 19:
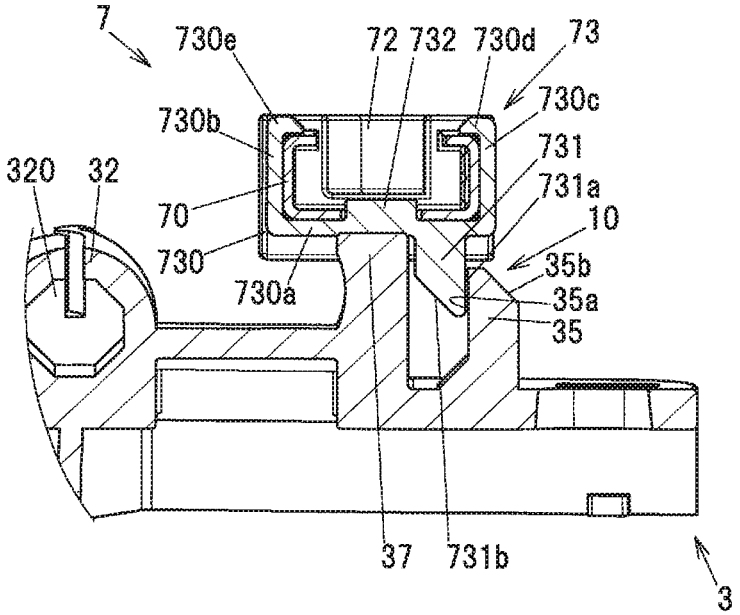
FIG. 19 is a cross sectional view taken along line A-A of FIG. 18.

FIG. 18 is a perspective view showing the configuration of the window regulator 1 in the temporarily held state. FIG. 19 is a cross sectional view taken along line A-A of FIG. 18 and is also an explanatory diagram illustrating the configuration of the temporary holding mechanism 10.

The temporary holding mechanism 10 is a mechanism to maintain the temporarily held state in which the swing bar 7 is held in the third position/orientation, and the temporary holding mechanism 10 has the holding portion 35 of the carrier plate 3, the protrusion 731 formed on the locking portion 73 of the swing bar 7 and provided as the held portion to be held by the holding portion 35, and the elastic member 8 generating an elastic force to cause engagement between the holding portion 35 and the protrusion 731.

Although the third position/orientation. in the first embodiment is the position/orientation. with which the swing bar 7 extends along the longitudinal direction of the guide rail 2, the third position/orientation is not limited thereto. That is, it is acceptable as long as the upper end cover 71 as a free end of the swing bar 7 is located close to the guide rail 2 within a range in which the swing bar 7 does not come into contact with other components at the time of installing the window regulator 1 to the door panel. Therefore, the swing bar 7 may be slightly inclined in the second direction from the above-described position/orientation along the guide rail 2.

As shown in FIGS. 18 and 19, the holding portion 35 of the carrier plate 3 is provided on the back surface 3*e* which is a facing surface of the carrier plate 3 and faces the protrusion 731 of the swing bar 7 in the vehicle width direction in the temporarily held state.

The temporary holding mechanism 10 maintains the temporarily held state by engagement between the holding portion 35 of the carrier plate 3 and the protrusion 731 of the locking portion 73 of the swing bar 7 at a predetermined temporarily held position of the carrier plate 3. In more detail, the side surface 731*a* of the protrusion 731 of the swing bar 7 which receives an elastic force in the second direction from the elastic member 8 comes into contact with the restricting surface 35*a* of the holding portion 35 of the carrier plate 3, and this contact maintains the temporarily held state.

The window regulator 1 can be put into the temporarily held state by firstly placing the swing bar 7 in the third position/orientation and then moving the carrier plate 3 to a predetermined temporarily held position.

Alternatively, the temporarily held state may be achieved by firstly arranging the carrier plate 3 at the temporarily held position and then swinging the swing bar 7 in the first direction. In this case, the swing bar 7 comes into contact with the holding portion 35 of the carrier plate 3. However, since the inclined surface 731*b* of the protrusion 731 of the locking portion 73 of the swing bar 7 slides on the restricting surface 35*a* of the holding portion 35 of the carrier plate 3 and the protrusion 731 of the swing bar 7 climbs over the holding portion 35 of the carrier plate 3, the swing bar 7 can be moved to the third position/orientation.

(Motion of the Window Regulator)

Figure 20A:
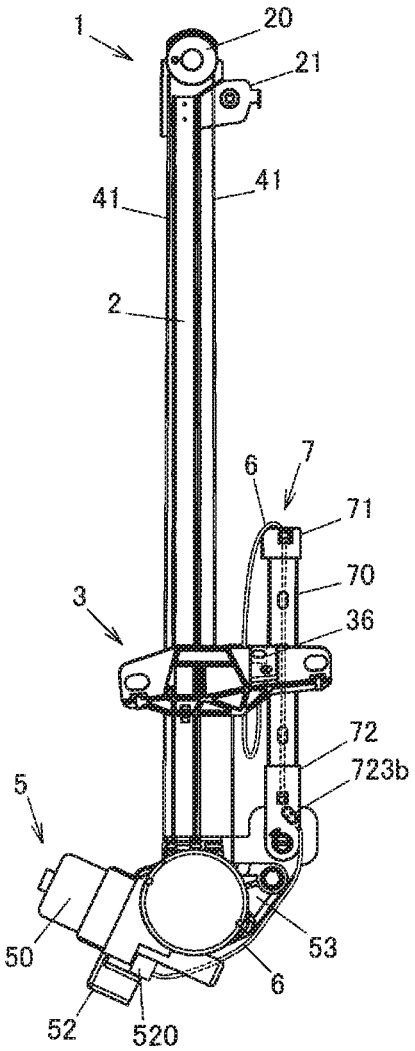
Figure 20B:
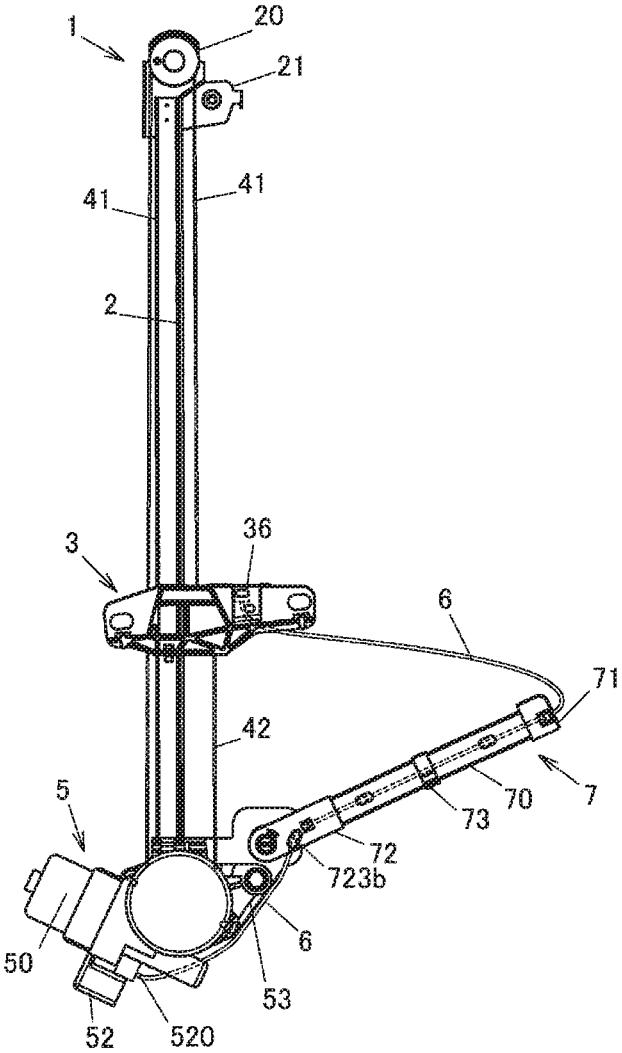
Figure 20C:
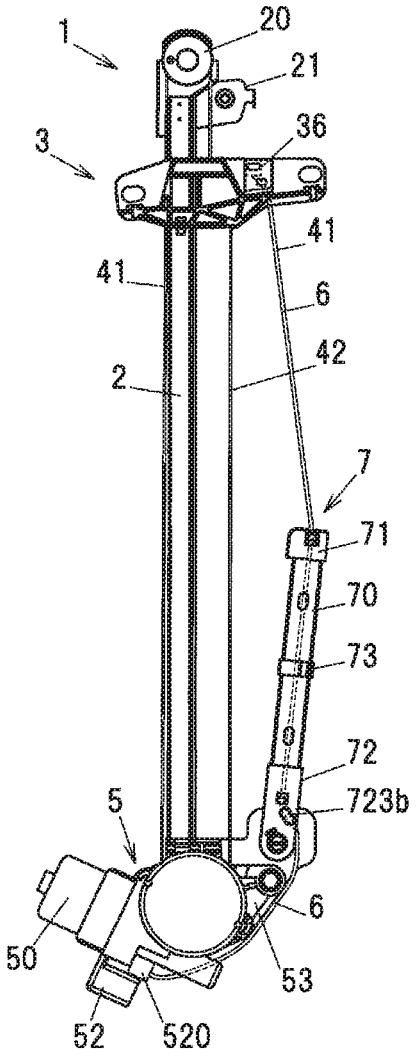
Figure 20D:
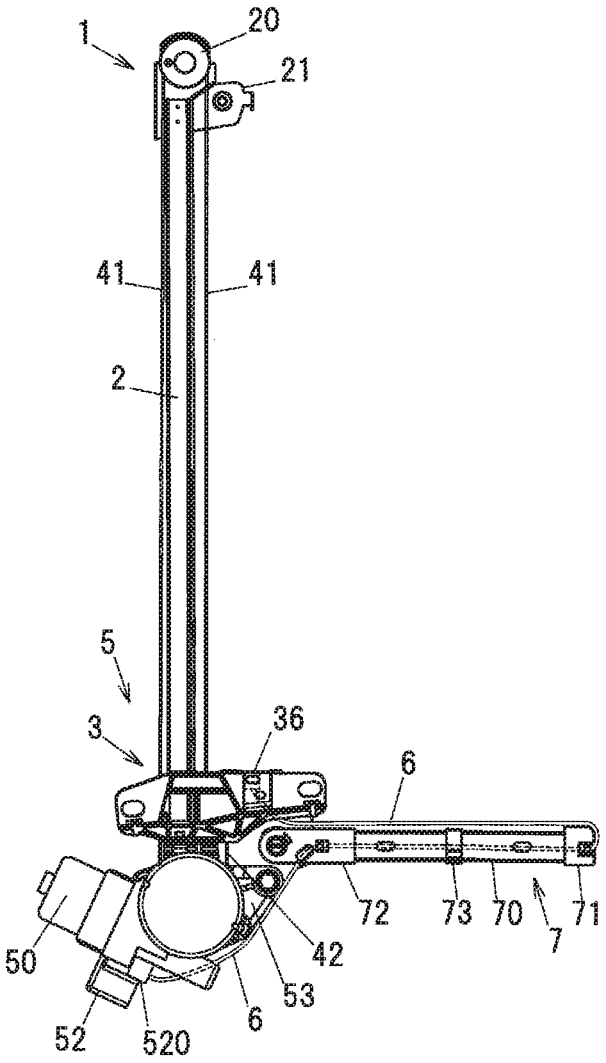

Next, motion of the window regulator 1 will be described in reference to FIG. 20. FIGS. 20A to 20D are explanatory diagrams illustrating motion of the window regulator 1, particularly, motion of the swing bar 7 with movement of the carrier plate 3, wherein FIG. 20A shows the temporarily held state, FIG. 20B shows the state in which the temporarily held state is released, FIG. 20C shows the state in which the carrier plate 3 is located at its top dead center, and FIG. 20D shows the state in which the carrier plate 3 is located at its bottom dead center. In FIGS. 20A to 20D, illustration of the window 90 is omitted for convenience of explanation.

Here, the top dead center is the position of the carrier plate 3 with respect to the guide rail 2 when the window 90 is fully closed, and the bottom dead center is the position of the carrier plate 3 with respect to the guide rail 2 when the window 90 is fully opened.

In the temporarily held state, the swing bar 7 is in the third position/orientation and extends along the longitudinal direction of the guide rail 2, as shown in FIG. 20A. In this state, engagement between the holding portion 35 of the carrier plate 3 and the protrusion 731 of the locking portion 73 of the swing bar 7 keeps the swing bar 7 in the third position/orientation. This reduces the size of the window regulator 1 in the vehicle longitudinal direction and thereby prevents the swing bar 7 from coming into contact with other components at the time of installing the window regulator 1 to the door panel, hence, installation workability is improved.

The window power feed wire 6 is connected to the power feed connector 36 of the carrier plate 3 at one end and to the power supply connector 520 of the motor housing 52 at the other end.

In more detail, the window power feed wire 6 extending out of the power feed connector 36 is inserted into the upper end cover 71 of the swing bar 7, is routed along the rail portion 70, and exits from the exit 723*b* of the lower end cover 72. The window power feed wire 6 extending out from the exit 723*b* is routed to the power supply connector 520 along the side portion of the drum housing 53.

In the temporarily held state, the window power feed wire 6 routed between the power feed connector 36 and the upper end cover 71 of the swing bar 7 is slack, and in this state, no tension is applied to the window power feed wire 6.

As shown in FIG. 20B, when the carrier plate 3 moves upward from the predetermined temporarily held position, the holding portion 35 of the carrier plate 3 is disengaged from the protrusion 731 of the locking portion 73 of the swing bar 7, and the swing bar 7 swings toward the second position/orientation. due to the elastic force of the elastic member 8. In other words, in the first embodiment, the temporarily held state is automatically released by movement of the carrier plate 3. Thus, it is not necessary to separately provide a configuration for releasing the temporarily held state, hence, the configuration is simplified. In addition, since the time and effort to release the temporarily held state after installing the window regulator 1 to the door panel is saved, it is more convenient. Although the example when moving up the carrier plate 3 is described in reference to FIG. 20B, it is possible to release the temporarily held state by moving down the carrier plate 3.

At the time of the disengagement described above, since the swing bar 7 swings in the second direction by the length of slack of the window power feed wire 6, the slack of the window power feed wire 6 is removed and tension is applied to the window power feed wire 6. As such, in the first embodiment, when the carrier plate 3 moves upward from the temporarily held state by a certain amount, the temporarily held state is automatically released and tension is applied to the window power feed wire 6. In more detail, tension is applied to the window power feed wire 6 between the fixing member provided on the carrier plate 3 to fix the window power feed wire 6 and the fixing member fixed in the first fixing hole 700*a* of the swing bar 7 to fix the window power feed wire 6.

The elastic force of the elastic member 8 in the second direction is set so that oscillation of the swing bar 7 due to the elastic force does not impede upward movement of the carrier plate 3.

When the carrier plate 3 further moves upward from the state shown in FIG. 20B while the window power feed wire 6 is in tension, the force of moving up the carrier plate 3 is transferred to the swing bar 7 via the window power feed wire 6. Thus, the swing bar 7 swings in the first direction due to the upward movement of the carrier plate 3.

As such, when the carrier plate 3 moves upward, the swing bar 7 receiving an elastic force of the elastic member 8 is pivoted in the first direction by the carrier plate 3 and tension is applied to the window power feed wire 6, hence, the window power feed wire 6 does not become slack.

Then, when the carrier plate 3 is located at the top dead center, the swing bar 7 is in the first position/orientation which is inclined by a predetermined angle in the second direction from the third position/orientation, as shown in FIG. 20C. Also, in this state, since the swing bar 7 constantly receives the elastic force in the second direction from the elastic member 8, the window power feed wire 6 is kept in tension and the slack of the window power feed wire 6 is prevented.

When the carrier plate 3 moves downward, the swing bar 7 swings in the second direction with downward movement of the carrier plate 3 since the swing bar 7 constantly receives the elastic force in the second direction from the elastic member 8. Thus, the window power feed wire 6 is kept in tension and the window power feed wire 6 does not become slack.

Then, when the carrier plate 3 is located at the bottom dead center, the swing bar 7 is in the second position/orientation which is inclined in the second direction from the first position/orientation and is substantially horizontal, as shown in FIG. 200. Also, in this state, since the swing bar 7 constantly receives the elastic force in the second direction from the elastic member 8, the window power feed wire 6 is kept in tension and the slack of the window power feed wire 6 is prevented.

Functions and Effects of the Embodiment

In the first embodiment, it is possible to obtain the following functions and effects.

(1) By providing the swing bar 7 with the window power feed wire 6 arranged thereon along the longitudinal direction and the elastic member 8 for applying an elastic force in the second direction to the swing bar 7, the swinging force of the swing bar 7 in the second direction is converted into tension of the window power feed wire 6 and the slack of the window power feed wire 6 is removed. This prevents a phenomenon in which, e.g., the window power feed wire 6 comes into contact with other components inside the door panel and makes noise when closing the door, which would happen when the window power feed wire 6 is slack.

(2) The window regulator 1 is provided with the temporary holding mechanism 10 which temporarily holds the swing bar 7. Therefore, when, e.g., inserting the window regulator 1 into an attachment hole formed on the door panel to install the window regulator 1 to the door panel, the swing bar 7 is prevented from coming into contact with other components or other regions. That is, the entire device at the time of installing the window regulator 1 is compact, and this means that it is possible to remove the slack of the window power feed wire 6 with a simple structure without decreasing the installation workability.

(3) At the temporarily held position of the carrier plate 3, the protrusion 731 as the held portion is disengaged from the holding portion 35 by moving the carrier plate 3. Thus, once the window regulator 1 is operated after installing the window regulator 1 to the door panel, the temporarily held state is automatically released. This saves the time and effort to release the temporarily held state, hence, convenient.

(4) The holding portion 35 of the temporary holding mechanism 10 is provided on the back surface 3*e* of the carrier plate 3 which faces the protrusion 731 of the swing bar 7 in the vehicle width direction. Therefore, when setting the temporary held state, the protrusion 731 of the swing bar 7 can be easily engaged with the holding portion 35 by using a clearance in the vehicle width direction around the carrier plate 3.

(5) In the first embodiment, since it is configured that the carrier plate 3 and the swing bar 7 are connected via the window power feed wire 6 and the swing bar 7 constantly receives the elastic force in the second direction, tension is constantly applied to the window power feed wire 6. That is, with the vertical movement of the carrier plate 3, the swing bar 7 swings in a direction of applying tension to the window power feed wire 6. This eliminates necessity of a complicated structure such as a wire reel used in the window regulator described in JP H1/154788 U, and it is possible to remove the slack of the window power feed wire 6 with a simple structure.

(6) Also, power could be wirelessly supplied to the window 90, but in this case, power to be supplied is large and this leads to an increase in size of the entire device. The first embodiment using a wired power supply means does not lead to such an increase in size.

(7) The window power feed wire 6 can be routed only by connecting the window power feed wire 6 to the power supply connector 520 and the power feed connector 36 and attaching a portion of the window power feed wire 6 to the swing bar 7. That is, work of, e.g., taking up the window power feed wire 6 is not necessary unlike the wire reel in JP H1/154788U, and it is thus easy to route the window power feed wire 6.

(Modification 1)

Figure 21:
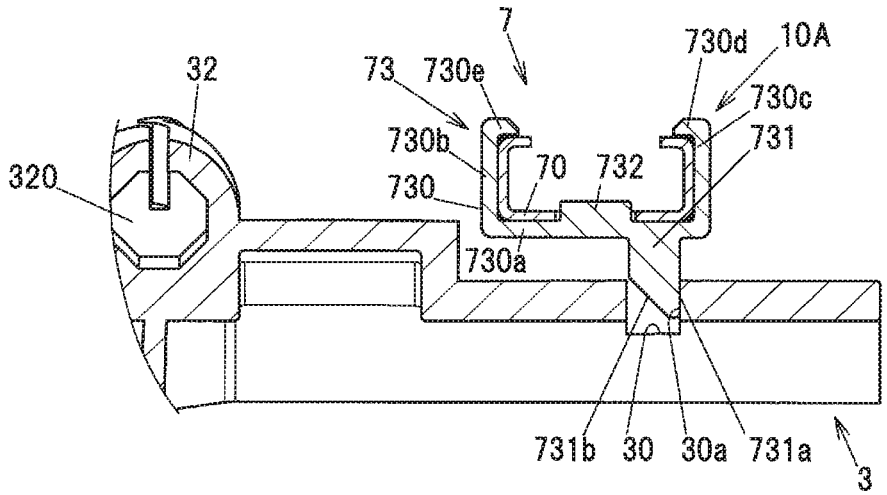
FIG. 21 is a cross sectional view showing a configuration of a temporary holding mechanism in the modification 1.

Next, the modification 1 of the temporary holding mechanism 10 in the first embodiment will be described in reference to FIG. 21. FIG. 21 is a cross sectional view showing a configuration of a temporary holding mechanism 10A in the modification 1. The cross section of FIG. 21 is taken in a direction along line A-A of FIG. 18, and illustration of the window power feed wire 6 is omitted for convenience of explanation.

In the temporary holding mechanism 10A. in the modification 1, the configuration of the holding portion which holds the protrusion 731 as the held portion provided on the swing bar 7 is different from the holding portion 35 in the first embodiment. In detail, the temporary holding mechanism 10A has a recessed groove 30 as the holding portion formed on the back surface 3*e* of the carrier plate 3, the protrusion 731 of the locking portion 73 of the swing bar 7 engaged with the recessed groove 30, and the elastic member 8 generating an elastic force to cause engagement therebetween. Due to the engagement by contact between a sidewall 30*a* of the recessed groove 30 of the carrier plate 3 and the side surface 731*a* of the protrusion 731 of the locking portion 73, the swing bar 7 is held in the temporarily held state. The modification 1 also can provide the same effects as the first embodiment.

(Modification 2)

Figure 22:
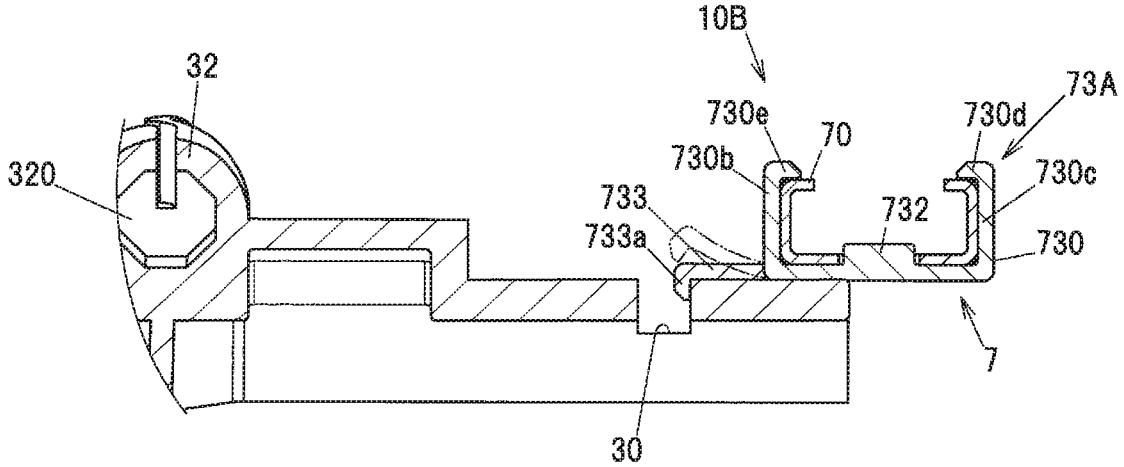
FIG. 22 is a cross sectional view showing a configuration of a temporary holding mechanism in the modification 2.

Next, a temporary holding mechanism 10B in the modification 2 will be described in reference to FIG. 22. FIG. 22 is a cross sectional view showing a configuration of the temporary holding mechanism 10B in the modification 2.

The temporary holding mechanism 10B in the modification 2 has the held portion which is different from the protrusion 731 as the held portion in the modification 1. The temporary holding mechanism 10B in the modification 2 has the recessed groove 30 as the holding portion formed on the carrier plate 3, an engagement claw 733 engaged with the recessed groove 30, and the elastic member 8 generating an elastic force to maintain the engagement between the recessed groove 30 and the engagement claw 733.

The engagement claw 733 is provided so as to protrude from the first wall portion 730*b* of the locking portion 73 of the swing bar 7. The engagement claw 733 is, e.g., a resin member and can be elastically deformed in the thickness direction of the carrier plate 3. Thus, even when, e.g., there is absolutely no clearance in the vehicle width direction around the carrier plate 3, it is possible to engage the swing bar 7 with the carrier plate 3 by elastically deforming the engagement claw 733 (indicated by a phantom line). The modification 2 also can provide the same effects as the first embodiment.

(Modification 3)

Figure 23:
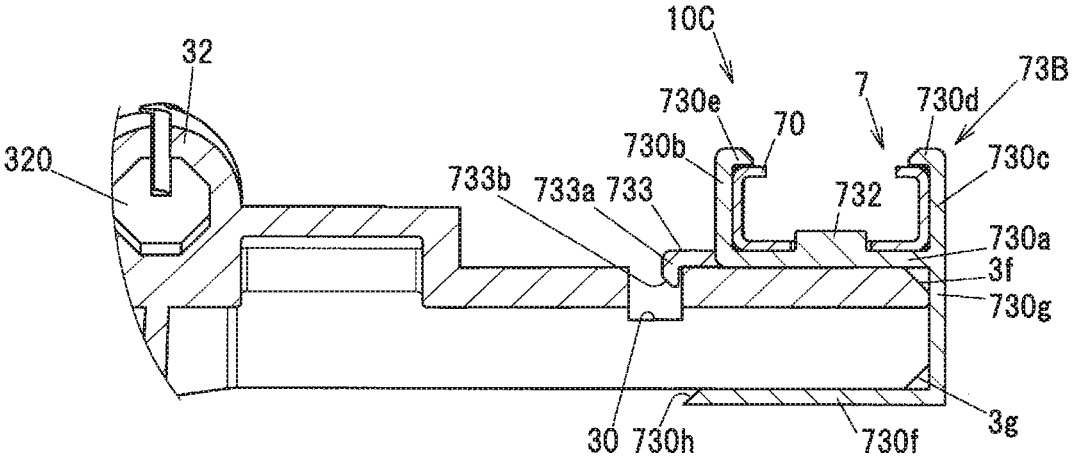
FIG. 23 is a cross sectional view showing a configuration of a temporary holding mechanism in the modification 3.

Next, a temporary holding mechanism 10C in the modification 3 will be described in reference to FIG. 23. FIG. 23 is a cross sectional view showing a configuration of the temporary holding mechanism 10C in the modification 3.

The temporary holding mechanism 10C has the recessed groove 30 as the holding portion, the engagement claw 733 as the held portion engaged with the recessed groove 30, the flat-plate portion 730*a* in contact with the back surface 3*e* of the on the carrier plate 3, a plate-shaped gripping portion 730*f* positioned so that the carrier plate 3 is sandwiched in the thickness direction between the flat-plate portion 730*a* and the gripping portion 7301; and a coupling portion 730*g* coupling the flat-plate portion 730*a* to the gripping portion 730*f*. A side edge of the carrier plate 3, which is a part of the carrier plate 3, is sandwiched in the vehicle width direction between the flat-plate portion 730*a* and the gripping portion 730*f*. The flat-plate portion 730*a* and the gripping portion 730*f* correspond to "the pair of walls" of the invention.

The configuration described above prevents a phenomenon in which the engagement claw 733 is disengaged from the recessed groove 30 due to the clearance in the vehicle width direction around the carrier plate 3. In other words, unintentional release of the temporarily held state is prevented.

In addition, an inclined surface 733*h* is formed at an end of the engagement claw 733, and an inclined surface 730*h* is formed at an end of the gripping portion 730*f*. It is configured that, when setting the temporary held state, the inclined surface 733*b* of the engagement claw 733 slides on a first chamfered portion 3*f* provided at a side edge of the carrier plate 3, and the inclined surface 730*h* of the gripping portion 730*f* slides on a second chamfered portion 3*g* provided at a side edge of the carrier plate 3. Thus, it is possible to easily set the temporary held state.

Second Embodiment

Figure 24:
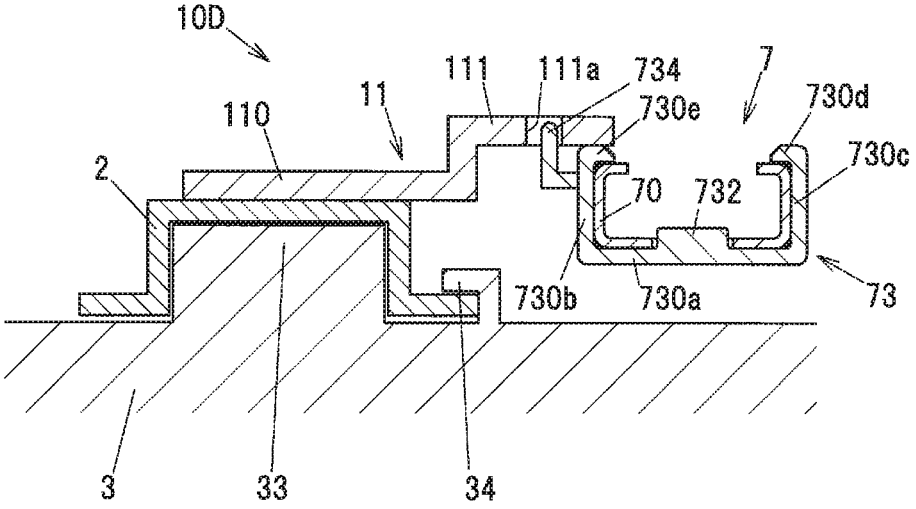
FIG. 24 is a cross sectional view showing a configuration of a temporary holding mechanism in the second embodiment.

Next, a temporary holding mechanism 10D in the second embodiment will be described in reference to FIG. 24. FIG. 24 is a cross sectional view showing a configuration of the temporary holding mechanism 10D in the second embodiment.

The temporary holding mechanism 10D in the second embodiment has a bracket 11 as the holding portion attached to the guide rail 2, and an engagement portion 734 as the held portion which is provided on the swing bar 7 and is engaged with the bracket H. The bracket 11 is arranged between the guide rail 2 and the swing bar 7 and is provided as a coupling portion which couples the guide rail 2 to the swing bar 7. The bracket 11 corresponds to "the bracket" of the invention.

The bracket 11 is, e.g., a thin metal member and integrally has a plate-shaped attachment portion 110 attached to the guide rail 2, and an engagement portion 111 which is provided continuously from the attachment portion 110 and has an engagement hole 111*a* engaged with the engagement portion 734. The engagement portion 734 can be elastically deformed in the vehicle width direction. The material of the bracket 11 is not limited to the metal and may be, e.g., a resin as long as the bracket 11 is an elastically deformable member.

The engagement portion 734 extends from the first wall portion 730*b* of the locking portion 73 of the swing bar 7 and an end portion of the engagement portion 734 is inserted into the engagement hole 111*a* of the bracket 11. This restricts the swing bar 7 from swinging in the second direction and maintains the temporarily held state.

In the second embodiment, when setting the temporary held state, the engagement portion 111 of the bracket 11 can be elastically deformed in a direction separating from the back surface 3*e* of the carrier plate 3 along the vehicle width direction (in the upward direction on the paper). Thus, it is easy to set the temporary held state even when there is no clearance in the vehicle width direction around the carrier plate 3. In addition, in the second embodiment, it is configured that the carrier plate 3 pushes the swing bar 7 toward the second position/orientation when the carrier plate 3 moves upward or downward from the predetermined temporary held position. When the carrier plate 3 moves from the predetermined temporary held position, the swing bar 7 is pushed by the carrier plate 3 and moves away from the guide rail 2. The engagement portion 734 provided on the swing bar 7 then pushes the engagement portion 111 of the bracket 11 in a direction separating from the back surface 3*e* of the carrier plate 3 along the vehicle width direction (in the upward direction on the paper). The engagement portion 111 of the bracket 11 is thereby elastically deformed and the engagement portion 734 is disengaged from the engagement portion 111 of the bracket 11. Although. the engagement portion 111 of the bracket 11 is elastically deformed in the second embodiment, the configuration may be such that the engagement portion 734 is elastically deformed.

Third Embodiment

Figure 25A:
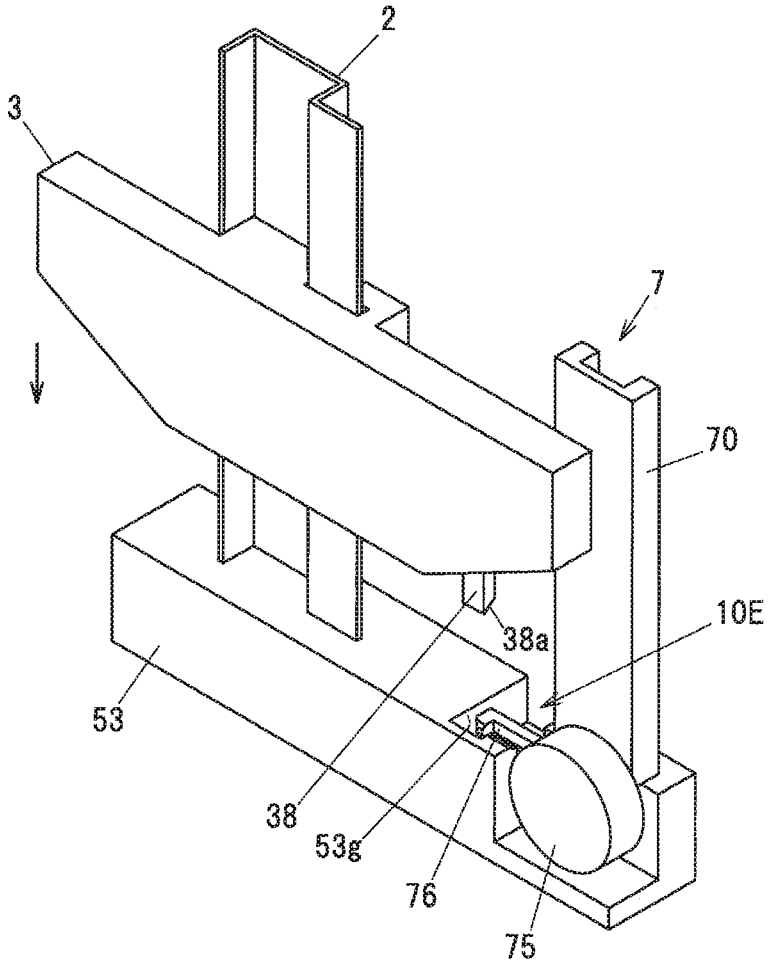
FIG. 25A is a schematic perspective view showing a configuration of a temporary holding mechanism in the third embodiment.
Figure 25B:
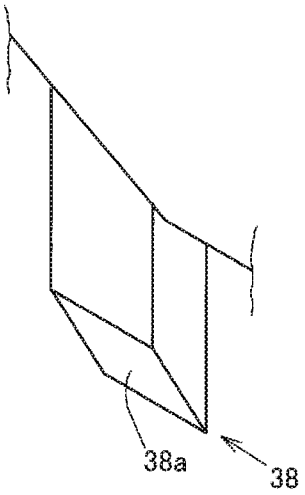
FIG. 25B is an enlarged perspective view showing a main portion of the carrier plate.
Figure 25C:
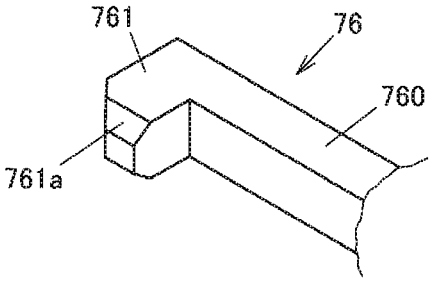
FIG. 25C is an enlarged perspective view showing a configuration of an engagement claw.
Figure 25D:
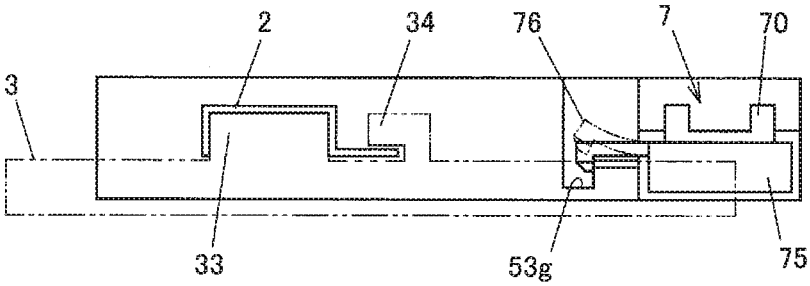
FIG. 25D is a top view showing the configuration of the temporary holding mechanism in the third embodiment.

Next, a temporary holding mechanism 10E in the third embodiment will be described in reference to FIG. 25. FIG. 25A is a schematic perspective view showing a configuration of a temporary holding mechanism in the third embodiment, FIG. 25B is an enlarged perspective view showing a main portion on the back side of the carrier plate 3, FIG. 25C is an enlarged perspective view showing the held portion, and FIG. 25D is a top view showing the temporarily holding mechanism. In FIG. 25D, the carrier plate 3 is indicated by a phantom line.

The temporary holding mechanism 10E in the third embodiment is different from the temporary holding mechanism 10 in the first embodiment in that the holding portion for temporarily holding the swing bar 7 is provided on the drum housing 53.

The temporary holding mechanism 10E in the third embodiment has a groove 53*g* formed on the drum housing 53 and an engagement claw 76 as the held portion engaged with the groove 53*g*. The engagement claw 76 extends from a circular cylindrical portion 75 provided at the lower end of the swing bar 7. Engagement between the engagement claw 76 and the groove 53*g* of the drum housing 53 restricts the swing bar 7 from swinging in the second direction and maintains the temporarily held state.

As shown in FIG. 25B, the carrier plate 3 has a protrusion 38 which sticks out downward from a side portion thereof. A pressing surface 38*a* which is inclined and provided to press an inclined surface 761*a* of the engagement claw 76 (described later) is formed on the protrusion 38.

As shown in FIG. 25C, the engagement claw 76 has an arm portion 760 extending outward from the circular cylindrical portion 75 in the radial direction thereof, and a claw portion 761 protruding from an end of the arm portion 760 along the vehicle width direction.

In the third embodiment, it is configured that the temporary held state is released when the carrier plate 3 reaches a predetermined position in the vicinity of the bottom dead center. In more detail, when the carrier plate 3 reaches the bottom dead center, the protrusion 38 of the carrier plate 3 comes into contact with the engagement claw 76 of the swing bar 7 and the pressing surface 38*a* of the protrusion 38 pushes the inclined surface 761*a* of the engagement claw 76. Then, the engagement claw 76 is elastically deformed in the vehicle width direction and is disengaged from the groove 53*g* of the drum housing 53, and the swing bar 7 thus can swing in the second direction due to the elastic force of the elastic member 8. The third embodiment also can provide the same effects as the first embodiment. In addition, since the holding portion is provided on the drum housing 53, it is not affected by the clearance in the vehicle width direction around the carrier plate 3.

Figure 26B:
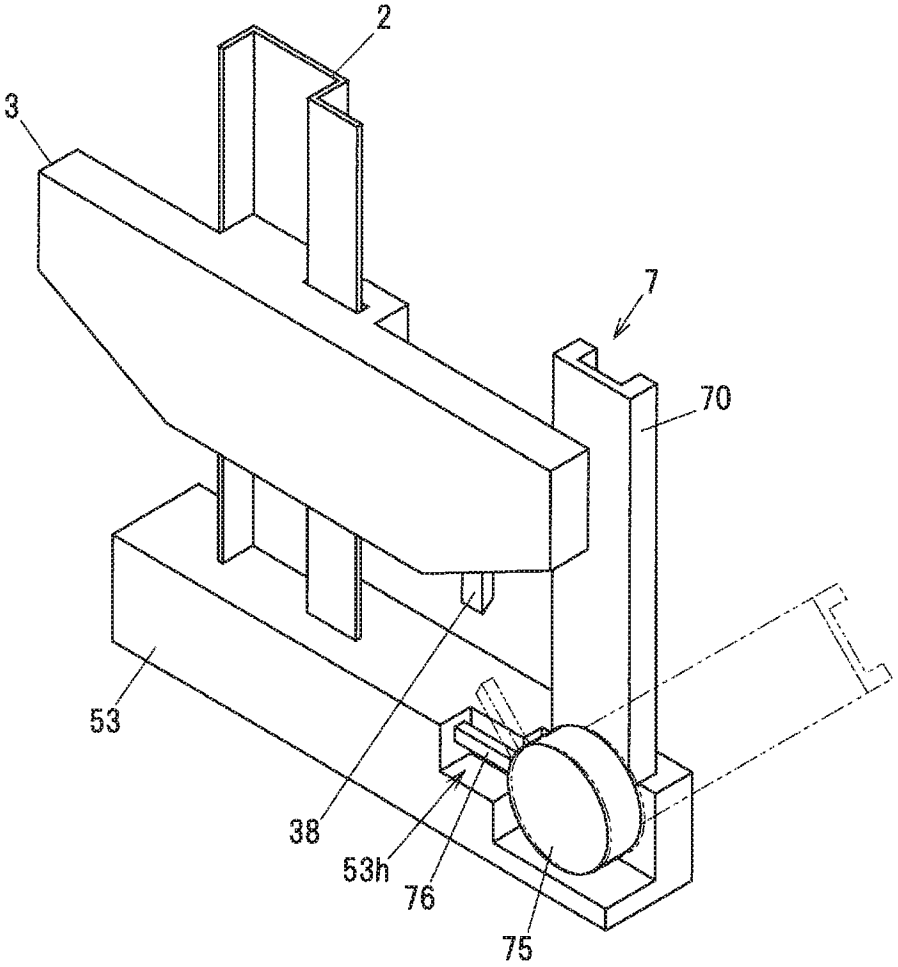
FIGS. 26A and 26B are schematic perspective views showing a configuration of a temporary holding mechanism in a modification of the third embodiment.
Figure 26A:
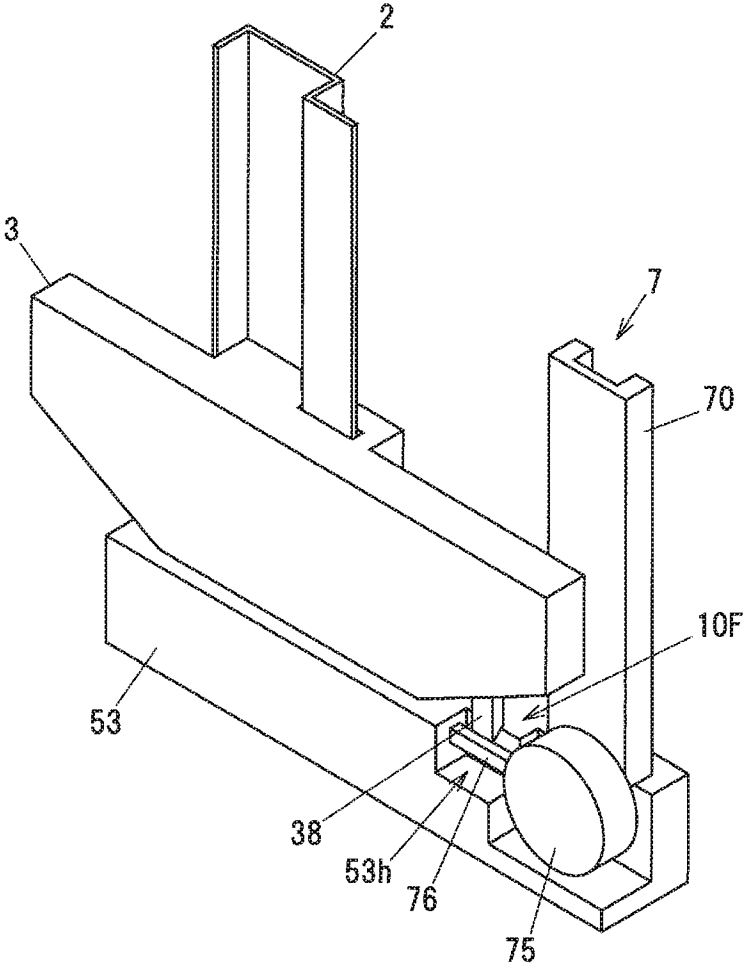

FIGS. 26A and 26B are schematic perspective views showing a configuration of a temporary holding mechanism 10F in a modification of the third embodiment.

The temporary holding mechanism 10F in the present modification is different from the temporary holding mechanism 10E in the third embodiment in that the temporarily held state is maintained by the protrusion 38 of the carrier plate 3. That is, in the present modification, the engagement claw 76 is simply located in a groove 53*h* formed on the drum housing 53, and contact between the protrusion 38 of the carrier plate 3 and the engagement claw 76 at the bottom dead center restricts the swing bar 7 from swinging and maintains the temporarily held state. Then, when the carrier plate 3 moves upward from the predetermined position in the vicinity of the bottom dead center, the engagement claw 76 is disengaged from the protrusion 38 and the swing bar 7 swings due to the elastic force of the elastic member 8. The present modification also can provide the same effects as the second embodiment.

Although the swing bar 7 is attached to the lower end side of the guide rail 2 in the embodiments, the mounting position of the swing bar 7 is not limited thereto. For example, the swing bar 7 may be attached to the upper end side of the guide rail 2.

Fourth Embodiment

Additionally, a temporary holding mechanism in the fourth embodiment will be described. The temporary holding mechanism in the fourth embodiment is different from the temporary holding mechanism 10 in the first embodiment in that the swing bar 7 is swingably supported on the carrier plate 3 and the holding portion for temporarily holding the swing bar 7 is provided on the drum housing 53.

This temporary holding mechanism maintains the temporarily held state by engagement between the holding portion of the drum housing 53 and the locking portion of the swing bar 7 at the predetermined temporarily held position of the carrier plate 3. Then, in the temporarily held state, the swing bar 7 is held in the third position/orientation which is along the longitudinal direction of the guide rail 2. The carrier plate 3 when located at the predetermined temporarily held position on the guide rail 2 is positioned so that a distance between the drum housing 53 and the carrier plate 3 is substantially equal to or smaller than the length of the swing bar 7. When the carrier plate 3 moves upward from the temporarily held position, the distance between the guide rail 2 and the carrier plate 3 becomes larger than the distance therebetween at the predetermined temporarily held position, the locking portion of the swing bar 7 is thus disengaged from the holding portion of the drum housing 53, and the swing bar 7 then swings toward the second position/orientation due to the elastic force of the elastic member 8. The fourth embodiment also can provide the same effects as the first embodiment.

Although the holding portion is provided on the drum housing 53 in the fourth embodiment, the position of the holding portion is not limited thereto. For example, the holding portion may be provided on the pulley bracket 21, or may be provided on a bracket fixed to the guide rail 2.

Although the embodiments of the invention have been described, the invention according to claims is not to be limited to the embodiments. For example, although the example of applying the invention to the window regulator 1 of so-called lower end drive type with the drive unit 5 provided at the lower end of the guide rail 2 has been described, it is not limited thereto. The invention is also applicable to a delta-type window regulator having the drive unit 5 separately from the guide rail 2, a window regulator having the drive unit 5 attached to the middle of the guide rail 2, a self-propelled window regulator with the drive unit 5 moving on the guide rail 2, and a dual rail window regulator provided with two guide rails 2.

In addition, although the examples of attaching the swing bar 7 to the lower end side of the guide rail 2, to the upper end side of the guide rail 2 and to the carrier plate 3 have been described in the embodiments, the mounting position of the swing bar 7 is not limited thereto. For example, the swing bar 7 may be attached to the upper end side of the guide rail 2, or the lower end cover 72 of the swing bar 7 may be attached to the longitudinal center of the guide rail 2. In this case, the lower end cover 72 of the swing bar 7 is attached to a bracket fixed to the guide rail 2.

In addition, the swing bar 7 in the embodiments may be provided with a positioning mechanism capable of positioning the upper end cover 71 with respect to the rail portion 70. This positioning mechanism has the rail portion 70 having plural positioning holes formed along the longitudinal direction and the upper end cover 71 capable of sliding on the rail portion 70, and is configured that the upper end cover 71 is slid on the rail portion 70 at the time of attaching the upper end cover 71 to the rail portion 70, and the upper-end fitting portion 713 of the upper end cover 71 is fitted to any of the positioning holes on the rail portion 70. In other words, according to the required length of the swing bar 7, the upper end cover 71 is fixed to the rail portion 70 at a positioning hole corresponding to the required length. As a result, it is not necessary to manufacture the swing bar 7 for every size of the window regulator 1, hence, versatility is enhanced.

Although the locking portion as the held portion is provided on the swing bar 7 in the embodiments, how to lock the swing bar 7 is not limited thereto. For example, the swing bar 7 may be directly held by the holding portion of the carrier plate 3 without providing the locking portion on the swing bar 7. Alternatively, for example, a magnet may be used as the holding portion of the carrier plate 3 to directly hold the metal portion of the swing bar 7 by magnetic attraction.

Although slack of the window power feed wire 6 used for supplying power to the window 90 is removed in the embodiments, the intended use of the wire subjected to slack removal is not limited thereto. For example, it is applicable to remove slack of a communication wire used for transmitting/receiving signals to/from the window 90.

Further, it should be noted that all combinations of the features described in the embodiments are not necessary to solve the problem of the invention. The invention can be appropriately modified and implemented without departing from the gist thereof.

The invention claimed is:

1. A window regulator, comprising:

a guide rail provided along an ascending direction and a descending direction of a window for a vehicle;

a carrier plate that slides on the guide rail and moves together with the window;

a window power feed wire for supplying power to the window;

a swing bar arranged to be swingable about a rotational axis thereof that is along a width direction of the vehicle;

an elastic member that generates an elastic force for swinging the swing bar in a predetermined direction; and a temporary holding mechanism for temporarily holding the swing bar so that the swing bar extends along a longitudinal direction of the guide rail, wherein the window power feed wire is hung over the swing bar.

2. The window regulator according to claim 1, wherein the temporary holding mechanism holds the swing bar at a predetermined position of the carrier plate to provide a temporarily held state, and the temporarily held state is released by movement of the carrier plate.

3. The window regulator according to claim 1, wherein the temporary holding mechanism comprises a holding portion engaged with a held portion provided on the swing bar, and the swing bar is temporarily held by engagement between the holding portion and the held portion of the swing bar.

4. The window regulator according to claim 3, wherein the holding portion is provided on a facing surface of the carrier plate that is a surface facing the held portion of the swing bar in a width direction of the vehicle.

5. The window regulator according to claim 4, wherein the swing bar comprises a pair of walls that sandwich a portion of the carrier plate in the width direction of the vehicle.

6. The window regulator according to claim 3, further comprising: a housing provided at a lower end of the guide rail, wherein the holding portion of the temporary holding mechanism is provided on the housing.

7. The window regulator according to claim 3, further comprising: a coupling member that couples the guide rail to the swing bar, wherein the holding portion of the temporary holding mechanism is provided on the coupling member.

* * * * *